US009585531B2

(12) United States Patent
Yoo et al.

(10) Patent No.: US 9,585,531 B2
(45) Date of Patent: Mar. 7, 2017

(54) NOZZLE ASSEMBLY HAVING SUBSIDIARY BRUSH UNIT

(71) Applicant: Samsung Electronics Co., Ltd, Gwangsan-gu, Gwangju-si (KR)

(72) Inventors: Dong Hun Yoo, Gwangju (KR); Yun Hee Park, Gwangju (KR)

(73) Assignee: SAMSUNG ELECTRONICS CO., LTD., Gwangsan-gu, Gwangju-si (KR)

( * ) Notice: Subject to any disclaimer, the term of this patent is extended or adjusted under 35 U.S.C. 154(b) by 381 days.

(21) Appl. No.: 14/178,553

(22) Filed: Feb. 12, 2014

(65) Prior Publication Data

US 2014/0196249 A1 Jul. 17, 2014

Related U.S. Application Data

(62) Division of application No. 11/900,024, filed on Sep. 7, 2007, now Pat. No. 8,671,513.

(Continued)

(30) Foreign Application Priority Data

Dec. 15, 2006 (KR) ..... 10-2006-0128520
Dec. 15, 2006 (KR) ..... 10-2006-0128522

(Continued)

(51) Int. Cl.
*A47L 9/04* (2006.01)
*A47L 9/06* (2006.01)

(52) U.S. Cl.
CPC ..... *A47L 9/0466* (2013.01); *A47L 9/04* (2013.01); *A47L 9/0488* (2013.01); *A47L 9/06* (2013.01); *A47L 9/0653* (2013.01); *A47L 9/0666* (2013.01)

(58) Field of Classification Search
CPC ..... A47L 9/0488; A47L 9/06; A47L 9/0466; A47L 9/04; A47L 9/0653; A47L 9/0666
See application file for complete search history.

(56) References Cited

U.S. PATENT DOCUMENTS 3,382,525 A * 5/1968 Belicka ..... A47L 9/06 15/365
6,421,874 B1 * 7/2002 McCormick ..... A47L 9/06 15/364

FOREIGN PATENT DOCUMENTS

DE 19602406 1/1997
DE 19738046 3/1999

(Continued)

*Primary Examiner* — Robert Scruggs
(74) *Attorney, Agent, or Firm* — Ohlandt, Greeley, Ruggiero & Perke, LLP

(57) ABSTRACT

A nozzle assembly usable with an upright vacuum cleaner, comprising: a nozzle assembly body; a drum brush unit disposed in the nozzle assembly body, the drum brush unit having a drum brush disposed to move dirt or dust adhered to a surface to be cleaned while coming in rotational contact therewith; a subsidiary brush unit disposed in front of the drum brush unit, and the subsidiary brush unit having a subsidiary brush to preliminarily move the dust or dirt adhered to the surface to be cleaned before the drum brush moves the dirt or dust adhered to the surface to be cleaned; and a locking unit disposed to the drum brush unit to selectively fix the subsidiary brush unit to the drum brush unit, wherein the subsidiary brush unit is rotatably connected to the drum brush unit to selectively maintain a contact state or a non-contact state to the surface to be cleaned, and, when the subsidiary brush unit maintains the contact state to the surface to be cleaned, the locking unit fixes the subsidiary brush unit to the drum brush unit.

20 Claims, 16 Drawing Sheets

Related U.S. Application Data

(60) Provisional application No. 60/850,736, filed on Oct. 11, 2006, provisional application No. 60/850,895, filed on Oct. 11, 2006, provisional application No. 60/875,898, filed on Dec. 20, 2006, provisional application No. 60/919,253, filed on Mar. 21, 2007.

(30) Foreign Application Priority Data

Feb. 14, 2007 (KR) ..... 10-2007-0015589
May 7, 2007 (KR) ..... 10-2007-0044275

(56) References Cited

FOREIGN PATENT DOCUMENTS

| | | | |
|---|---|---|---|
| EP | 1092380 | * | 4/2001 |
| EP | 1228732 | | 8/2002 |
| GB | 2072495 | | 10/1981 |
| GB | 2398735 | | 12/2003 |
| JP | 04132529 | | 5/1992 |
| JP | 07163495 | | 6/1995 |
| JP | 2006340848 | | 12/2006 |
| KR | 1020050038426 | | 4/2005 |

* cited by examiner

NOZZLE ASSEMBLY HAVING SUBSIDIARY BRUSH UNIT

CROSS-REFERENCE TO RELATED APPLICATIONS

This application is a Divisional Application of U.S. patent application Ser. No. 11/900,024, filed on Sep. 7, 2007, and claims the benefit under 35 U.S.C. §119(e) of U.S. Provisional Patent Application Nos. 60/850,736, 60/850,895, 60/875,898, and 60/919,253, filed Oct. 11, 2006, Oct. 11, 2006, Dec. 20, 2006, and Mar. 21, 2007, respectively, in the United States Patent and Trademark Office, and claims the benefit under 35 U.S.C. §119(a) of Korean Patent Application Nos. 10-2006-0128520, 10-2006-0128522, 10-2007-0015589, 10-2007-0044275, filed on Dec. 15, 2006, Dec. 15, 2006, Feb. 14, 2007, and May 7, 2007, respectively, in the Korean Intellectual Property Office, the entire contents of all of which are hereby incorporated by reference.

BACKGROUND

1. Field of the Disclosure

The present disclosure relates to a vacuum cleaner. More particularly, the present disclosure relates to a nozzle assembly of a vacuum cleaner, which comes in contact with a surface to be cleaned to draw in dust or dirt with air from the surface to be cleaned.

2. Description of the Related Art

In general, a vacuum cleaner is provided with a nozzle assembly capable of drawing in dust or dirt from a surface to be cleaned. Such a nozzle assembly draws in the dirt or the dust from the surface to be cleaned by a suction force generated form a suction motor mounted in a cleaner body in a state where it comes in contact with the surface to be cleaned.

However, among such conventional nozzle assemblies, a nozzle assembly, which is applied to an upright vacuum cleaner, has a drum brush unit to brush away the dust or dirt stained to the surface to be cleaned, more particularly, a carpet. The nozzle assembly including the drum brush unit is disclosed in Japanese patent publication No. 4132529, German patent publication DE 19602406, and Korean patent publication No. 10-2004-0075569. The disclosed nozzle assembly has a drum brush rotatably joined to a cleaner body, so that it strikes dust or dirt of a surface to be cleaned in an dust inlet thereof to brush away the dust or dirt from the surface to be cleaned. The drum brush is rotated by a motor mounted in the nozzle assembly or by a kinetic energy of drawn-in air. A brush member or blade projected from an outer circumferential surface of the drum brush strikes the surface to be cleaned in a tangential direction while coming in rotation contact therewith. When the drum brush strikes a portion of the surface to be cleaned, which is stained with the dust or dirt, the dust or dirt is scattered while separating from the portion of the surface to be cleaned, and is drawn into the nozzle assembly.

However, dirt, such as hair, fur or the like, which is firmly stuck to the surface to be cleaned, particularly, a surface of carpet, is not separated therefrom well only by the drum brush. Although the drum brush strikes or scrapes against the surface to be cleaned while rotating, scraping strength thereof is too weak to separate the dirt from the surface to be cleaned. If spidery dirt, such as the hair, the fur or the like, is wound on cilia or fibers of the carpet, it is not easily separated from the carpet. In this case, there is an inconvenience in that to clean the carpet, a user should take the spidery dirt off one by one from the carpet, or clean the carpet again by using a cleaning outfit, such as a comb or the like.

SUMMARY

An aspect of the present disclosure is to address at least the above problems and/or disadvantages and to provide at least the advantages described below. Accordingly, an aspect of the present disclosure is to provide a nozzle assembly of a vacuum cleaner capable of cleaning hair or fur of a pet as well as dust or dirt, which is firmly stuck to a surface to be cleaned.

Another aspect of the present disclosure is to provide a nozzle assembly of a vacuum cleaner having a subsidiary brush capable of selectively coming in contact or non-contact with a surface to be cleaned according to whether there is a need to use it.

Further another aspect of the present disclosure is to provide a nozzle assembly of a vacuum cleaner having a subsidiary brush, which is convenient to use, maintain and repair.

Still another aspect of the present disclosure is to provide a nozzle assembly of a vacuum cleaner having a subsidiary brush capable of coming in contact with a surface to be cleaned well even though the surface to be cleaned is crooked or irregular.

In accordance with an aspect of the present disclosure, a nozzle assembly of a vacuum cleaner includes a nozzle assembly body; a drum brush unit disposed in the nozzle assembly body, and having a drum brush disposed to brush away dirt or dust adhered to a surface to be cleaned while coming in rotation contact therewith; and a subsidiary brush unit disposed to the nozzle assembly body or the drum brush unit, and having a subsidiary brush to preliminarily brush away the dust or dirt adhered to the surface to be cleaned. With the subsidiary brush unit disposed to the nozzle assembly body or the drum brush unit to preliminarily brush away the dust or dirt, the nozzle assembly can efficiently clean the dirt, particularly, hair or the like, from the surface to be cleaned, particularly, a carpet.

Here, preferably, but not necessarily, the subsidiary brush unit is rotatably connected to the nozzle assembly body or the drum brush unit to selectively maintain a contact state or a non-contact state to the surface to be cleaned. Accordingly, when a floor, a carpet or a quilt is cleaned, the subsidiary brush unit can be selectively used.

According to an exemplary embodiment of the present disclosure, the subsidiary brush unit may be disposed to the nozzle assembly body and may include a subsidiary brush member to selectively maintain the contact state or the non-contact state to the surface to be cleaned, at least one bracket member having one side connected to the nozzle assembly body, and at least one link member to connect the bracket member and the subsidiary brush member. Here, the link member may be rotatably connected to the bracket member and the subsidiary brush member.

The subsidiary brush unit may further include at least one guide member to connect the subsidiary brush member and the bracket member. The bracket member may have at least one guide groove formed therein, and one end of the guide member may be inserted into and moved in the guide groove to change a position of the subsidiary brush member.

Also, the subsidiary brush unit may further include at least one rotation-prevention part to restrict a rotation of the link member. Here, the rotation-prevention part may be configured to include a hook to restrain the link member from rotating in a direction toward the surface to be cleaned, and a stopper to restrain the link member from rotating in an opposite direction to the direction toward the surface to be cleaned, which are disposed on the bracket member.

The subsidiary brush member may include a subsidiary brush casing rotatably connected with the link member, and a subsidiary brush joined to the subsidiary brush casing to selectively maintain the contact state or the non-contact state to the surface to be cleaned. Here, the subsidiary brush may be detachably joined to the subsidiary brush casing, and may include a plurality of protrusions projected from a surface thereof facing the surface to be cleaned.

In accordance with another aspect of the present disclosure, a nozzle assembly of a vacuum cleaner includes left and right bracket parts projected forward from both sides of the front face of the drum brush unit, and the subsidiary brush unit may be connected to the left and the right bracket parts.

In an exemplary embodiment of the present disclosure, the subsidiary brush unit may be configured to include a frame member rotatably connected to the drum brush unit, an upper casing to wrap an upper part of the frame member, a lower casing connected with the upper casing to wrap a lower part of the frame member, and a subsidiary brush member detachably connected to an undersurface of the lower casing. The upper and the lower casings may be configured, so that they are movable up and down and rotatable.

The frame member may include a frame body, at least one frame key projected downward from a lower end of the frame body, a frame axis projected from both sides of the frame body, and uneven parts disposed on both ends of the frame axis, respectively.

The left and the right bracket parts may include elongated holes formed in a horizontal direction therein, respectively. In this case, the nozzle assembly may further include first elastic members inserted in the elongated holes, respectively, and cam members engaged with the uneven parts of the frame member, respectively.

At least one key may be projected from inner walls of the elongated holes, respectively and at least one key groove may be formed on the cam members, respectively. In this manner, the cam members may be configured to move in the horizontal direction with respect to a rotating movement of the frame member. At least one boss may be formed in the lower casing so as to accommodate the frame key of the frame member therein, and a second elastic member may be disposed in the boss.

In accordance with further another aspect of the present disclosure, a nozzle assembly of a vacuum cleaner includes a locking unit disposed to the drum brush unit to selectively fix the subsidiary brush unit thereon. Accordingly, with the locking unit, the subsidiary brush unit can be rotated from a use position to a non-use position when it is temporarily not used, and fixed to the use position when it is used.

Also, the drum brush unit may include a drum brush, and a drum brush casing to wrap the drum brush, and the subsidiary brush unit may be configured to join with or separate from the drum brush casing.

The locking unit may include a hook member to lock to the subsidiary brush unit, and a spring to press the hook member in a upward direction, the subsidiary brush unit may include a subsidiary brush casing, a panel joined to a lower end of the subsidiary brush casing, and a subsidiary brush joined to a lower end of the panel, and the subsidiary brush casing may be selectively locked to the hook member of the locking unit.

In addition, the panel may be configured to be elastically movable up and down and to be rotatable. For this, the panel may include a plurality of bosses formed on a upper surface thereof, each of the bosses having a spring disposed therein, and supporting axes formed on both ends thereof and rotatably supported in elongated holes formed in the subsidiary brush casing. The subsidiary brush may include a plurality of protrusions projected from an undersurface thereof.

Also, the drum brush casing may have at least one bracket disposed thereon, the subsidiary brush casing may have at least one cover arm rotatably joined to the bracket, and the bracket may be configured to mount on or separate from the drum brush casing.

Also, the drum brush casing may have at least one sliding rail disposed thereon, and the bracket may have at least one sliding groove joined with the sliding rail.

In accordance with still another aspect of the present disclosure, the subsidiary brush unit is configured, so that the panel is disposed to be movable back and forth and in a horizontal direction with respect to the subsidiary brush casing. For this, the subsidiary brush unit may include at least one hinge bracket disposed between the panel and the subsidiary casing to hingedly fix the panel to the subsidiary brush casing and thus to move the panel in the horizontal direction to the subsidiary brush casing. The hinge bracket may include a body fixed to a fixing boss formed on a undersurface of the subsidiary brush casing, and a link member having at least one link hingedly fixed to the body and the panel by hinge screws. In this manner, preferably, but not necessarily, each of the hinge screws includes a raised portion rotatably supported in one of hinge holes formed in both ends of the link, and a screw portion screwed to the panel or body.

The subsidiary brush may include a picker attached to an undersurface of the panel and formed of a wool, cloth, or fabric with shag. In this manner, preferably, but not necessarily, the picker is formed, so that a shag portion thereof has a texture inclined in one direction, for example, a direction toward the drum brush unit. In this case, to exactly set the texture of the shag in fabrication, a first positioning part may be disposed between the panel and the picker to position the picker to panel, and a second positioning part may be disposed between the subsidiary brush casing and the panel to position the panel to the subsidiary brush casing. Preferably, but not necessarily, the first positioning part includes a projection formed on a side of the undersurface of the panel, and a projection-accommodating groove formed in the picker to accommodate the projection, and the second positioning part includes at least two ribs formed on a undersurface of the subsidiary brush casing, the two ribs being apart from the center of the subsidiary brush casing in different distances, and at least two rib-accommodating spaces formed on an upper surface of the panel to correspond to the ribs and to accommodate the ribs.

BRIEF DESCRIPTION OF THE DRAWINGS

The above and other objects, features, and advantages of certain exemplary embodiments of the present disclosure will be more apparent from the following description taken in conjunction with the accompanying drawings, in which.

Throughout the drawings, the same reference numerals will be understood to refer to the same elements, features, and structures.

DETAILED DESCRIPTION OF THE PREFERRED EMBODIMENTS

Hereinafter, a nozzle assembly of a vacuum cleaner according to exemplary embodiments of the present disclosure will be described in detail with reference to the accompanying drawing figures.

First Embodiment

Figure 1:
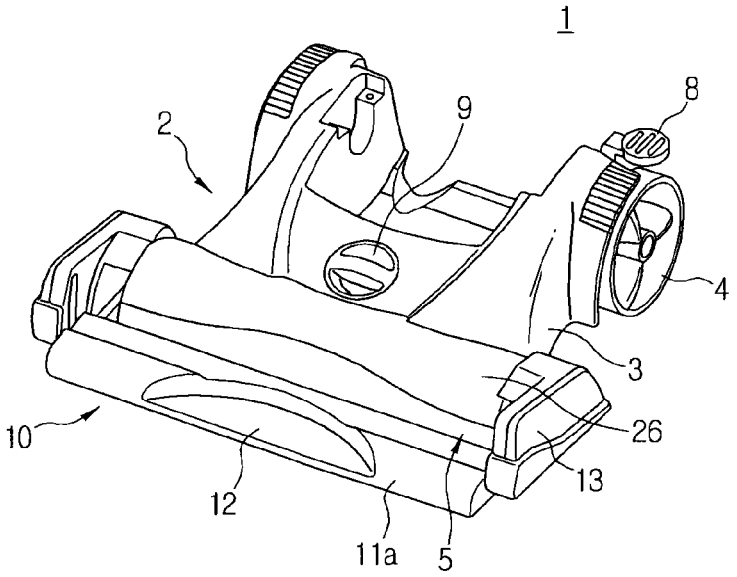
FIG. 1 is a perspective view exemplifying a nozzle assembly of a vacuum cleaner according to a first exemplary embodiment of the present disclosure.
Figure 2:
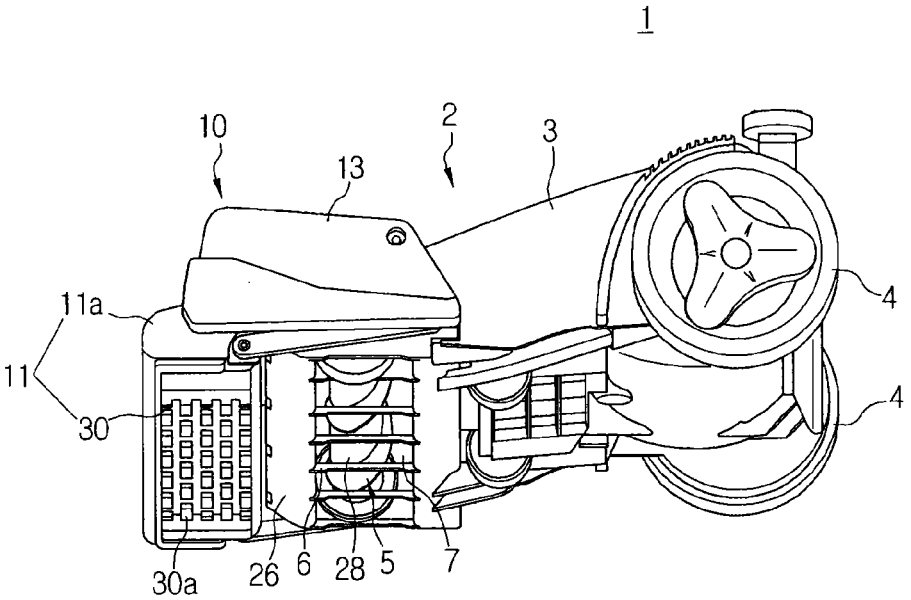
FIG. 2 is a perspective view diagonally exemplifying an undersurface of the nozzle assembly of FIG. 1.
Figure 3:
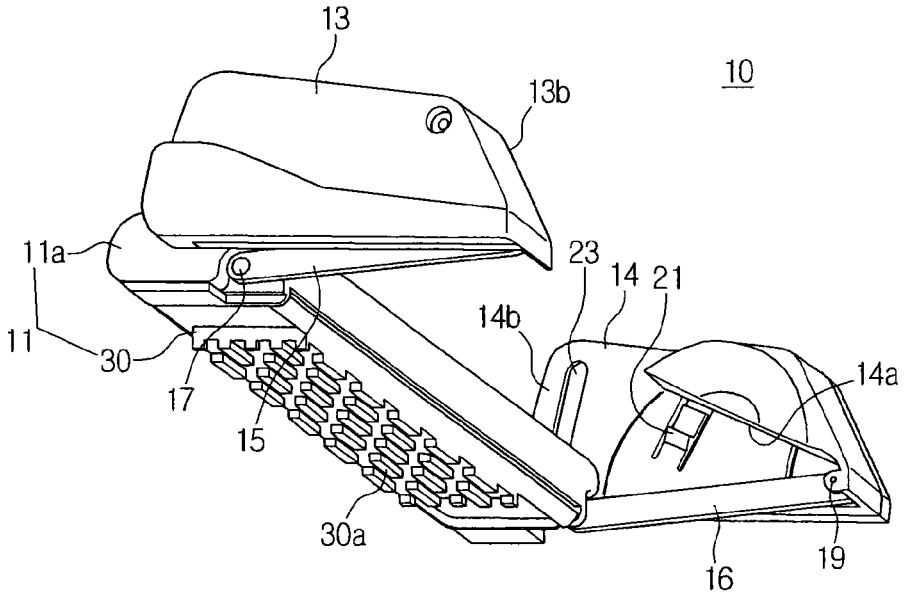
FIG. 3 is a perspective view exemplifying only a subsidiary brush unit of the nozzle assembly of FIG. 1.

Referring to FIGS. 1 through 3, there is illustrated a nozzle assembly 1 according to a first exemplary embodiment of the present disclosure. The nozzle assembly 1 includes a nozzle assembly body 2, a drum brush unit 5 and a subsidiary brush unit 10.

The nozzle assembly body 2 includes a body casing 3. The body casing 3 has an air passage (not illustrated), which is connected to a dust inlet 7 (see FIG. 2) formed in the drum brush unit 5. Accordingly, when a vacuum motor (not illustrated) mounted in a cleaner body (not illustrated) generates a suction force, dust or dirt along with air is drawn in through the dust inlet 7, and flows into the cleaner body in the rear of the nozzle assembly body 2 via the air passage of the nozzle assembly body 2. In addition, a turbine, which is rotated by the drawn-in air, or a driving motor (not illustrated), which drives a drum brush 28, can be disposed in the body casing 3. To easily move the nozzle assembly 1, a pair of wheels 4 is installed in the rear of the body casing 3. A lever 8 for tilting the cleaner body connected to a rear side of the nozzle assembly 1 is disposed on the body casing in the vicinity of one of the pair of wheels 4. In FIG. 1, a reference numeral 9 is a height adjusting knob. Since constructions of the lever and the height adjusting knob 9 are the same as those of the conventional ones, detailed descriptions thereof will be omitted.

The drum brush unit 5 includes a drum brush casing 26, and a drum brush 28.

The drum brush casing 26 may be integrally formed with or separately from the body casing 3, and has the drum brush 28 disposed therein. The dust inlet 7 is formed in an undersurface of the drum brush casing 26 to draw in the dust or dirt and the air. To prevent a patch of quilt or cloth among the air laden with the dust or dirt drawn in through the dust inlet 7 from flowing into the cleaner body, a plurality of ribs 6 are formed to cross the dust inlet 7.

The drum brush 28 strikes the surface to be cleaned in a tangential direction while coming in rotation contact with the surface to be cleaned and thus brushes away the dust or dirt adhered to the surface to be cleaned. For this, the drum brush 28 is rotatably disposed inside of the dust inlet 7 of the body casing 3. The drum brush 28 may be connected to the turbine or the driving motor of the body casing 3 as described above and rotated thereby.

The subsidiary brush unit 10 is installed in front of the body casing 3, so that it preliminary brushes away the dust or dirt adhered to the surface to be cleaned in front of the drum brush 28. Preferably, but not necessarily, the subsidiary brush unit 10 is installed to pivotable in a certain angle to the body casing 3.

Referring to FIG. 3, the subsidiary brush unit 10 includes a subsidiary brush member 11, left and right bracket members 13 and 14, and left and right links 15 and 16.

The subsidiary brush member 11 scrapes against the surface to be cleaned, particularly, a carpet or the like, to separate the dust or dirt, particularly, hair or fur of a pet tangled thereto, and includes a subsidiary brush casing 11*a* and a subsidiary brush 30.

Figure 8:
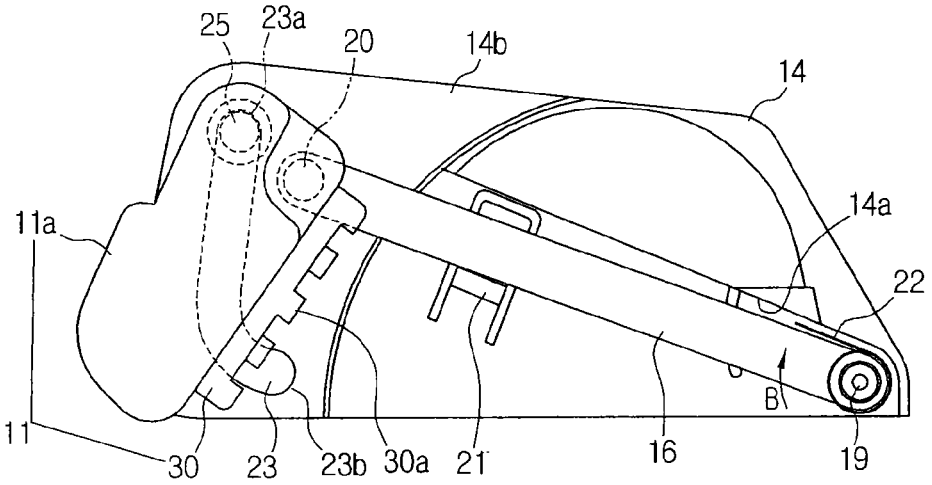
FIG. 8 is a view exemplifying only a subsidiary brush member, a right bracket member, and a right link of the subsidiary brush unit of the nozzle assembly of FIG. 1 when a subsidiary brush member of the subsidiary brush unit is folded, the subsidiary brush member being schematically illustrated, so that a guide member and a second hinge axis is shown.
Figure 9:
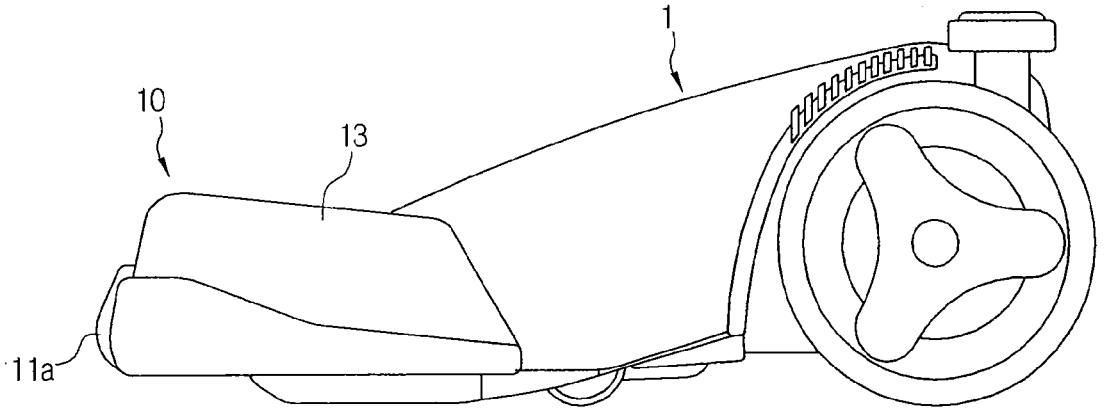
FIG. 9 is a side elevation view exemplifying the nozzle assembly of FIG. 1 when the subsidiary brush member is folded.

The subsidiary brush casing 11*a* is formed to have an approximately rectangular cross section. The subsidiary brush casing 11*a* at an upper side thereof has a handle 12 (see FIG. 1) installed to allow a user to apply a force to the subsidiary brush member 11 and thus to fold and unfold it. The subsidiary brush casing 11*a* can be formed in various shapes or materials according to the object of the use. The subsidiary brush casing 11*a* at both sides thereof has a pair of guide members 25 (see FIG. 8, only a right guide member illustrated), such as guide rollers. The pair of guide members 25 is inserted into left and right guide grooves 23 (only a right guide groove illustrated) formed on inner side surfaces 13*b* and 14*b* of the left and the right bracket member 13 and 14, respectively, so that they guide folding and unfolding movements of the subsidiary brush member 11.

Figure 4:
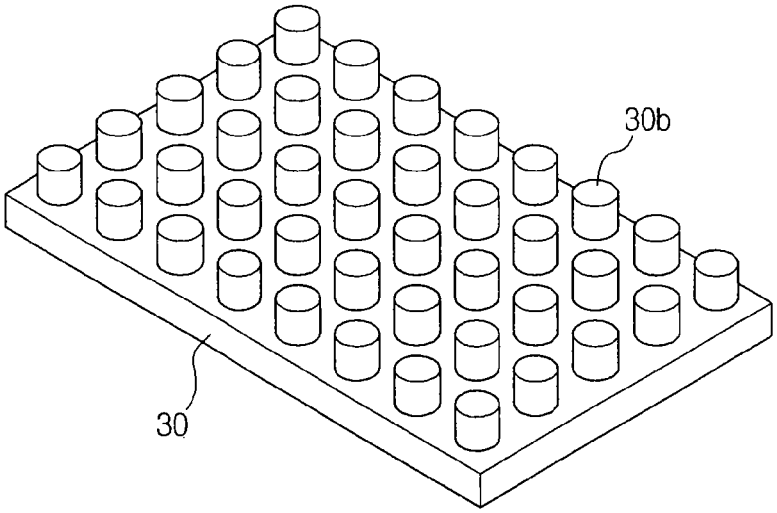
FIG. 4 is a view exemplifying another example of projections of a subsidiary brush of the subsidiary brush unit of FIG. 1.
Figure 5:
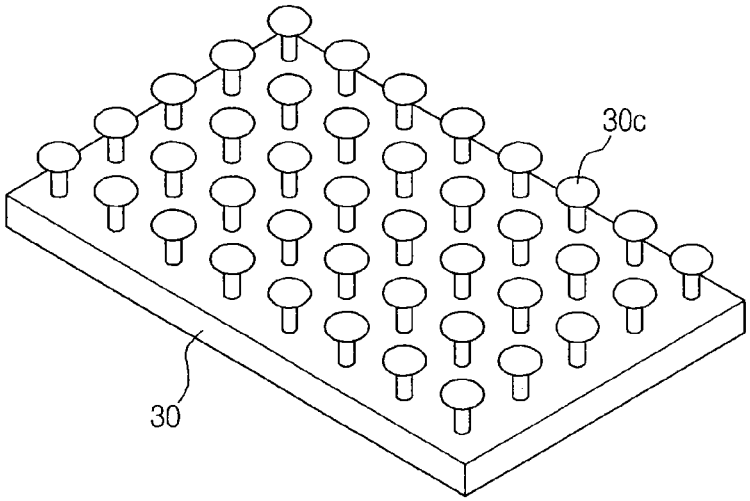
FIG. 5 is a view exemplifying still another example of the projections of the subsidiary brush of the subsidiary brush unit of FIG. 1.

The subsidiary brush 30 is joined to an undersurface of the subsidiary brush casing 11*a*, and has a plurality of projections 30*a* formed on an undersurface thereof, so that it can scrape against the carpet or the like to separate the hair or fur tangled thereto. Each of the plurality of projections 30*a* is formed in a rectangular parallelepiped shape, and projected toward the surface to be cleaned from the subsidiary brush 30. Alternatively, instead of the rectangular parallelepiped shape, each of the plurality of the projections can be formed in a cylinder shape 30*b* as illustrated in FIG. 4, or a sphere shape 30*c*, which is configured, so that an end tip coming in contact with the surface to be cleaned is supported on a cylinder projected from the subsidiary brush 30 and rounded to have a diameter larger than that of the cylinder, as illustrated in FIG. 5. Also, in the exemplary embodiment of the present disclosure, the subsidiary brush 30 and the projections 30*a* are formed of a rubber having elasticity. The subsidiary brush 30 is detachably joined to the undersurface of the subsidiary brush casing 11*a*. Accordingly, in maintenance, since only the subsidiary brush 30 stained with the dust or dirt after use can be separated from the subsidiary brush casing 11*a* and cleaned, it is easy to maintain and repair the subsidiary brush 30.

The left and the right bracket members 13 and 14 are fixed to both sides of the front of the body casing 3, and supports the subsidiary brush member 11 to pivot in a certain angle about the nozzle assembly body 2. Constructions of the left and the right bracket members 13 and 14 are the same. Referring to FIGS. 2 and 3, the left and the right bracket members 13 and 14 are connected to the left and the right fronts of the body casing 3, respectively, so that they are symmetrically disposed to each other while interposing the subsidiary brush member 11 therebetween. Thus, since the left and the right bracket members 13 and 14 have the same construction, only the right bracket member 14 will be explained in detail below.

In the inner side surface 14*b* of the right bracket member 14 is formed the right guide groove 23, which guides the pivot movement of the subsidiary brush member 11. The guide member 25 installed on the subsidiary brush casing 11*a* is inserted in the right guide groove 23. When the guide member 25 is positioned to a top 23*a* of the right guide groove 23, the subsidiary brush member 11 is comes to a folded state, that is, a state where it is approximately perpendicular to the surface to be cleaned (see FIG. 8). When the guide member 25 is positioned to a bottom 23*b* of the right guide groove 23, the subsidiary brush member 11 is comes to an unfolded state, that is, a state where it is parallel to the surface to be cleaned (see FIG. 10)

Also, on the right bracket member 14 is installed a rotation-prevention part to restrict a pivot movement of the right link 16. The rotation-prevention part includes a stopper 14*a* and a hook 21.

The stopper 14*a* restricts an angle where the right link 16 is pivoted upward, and is projected in a predetermined distance from the inner side surface 14*b* of the right bracket member 14, so that the right link 16 is not exposed to the outside.

Figure 6:
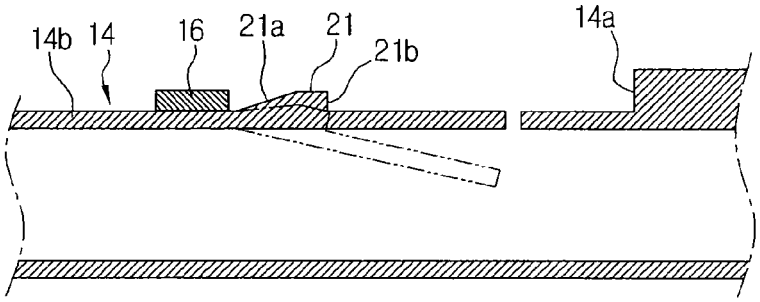
FIG. 6 is a cross-sectional view exemplifying a hook of a rotation-prevention part of the subsidiary brush unit of FIG. 1.

The hook 21 restrains the right link 16 from pivoting downward, and is formed on the inner side surface 14*b* of the right bracket member 14, so that the right link 16 can climb up and cross over the hook 21 when the user applies the force to the subsidiary brush member 11. As illustrated in FIG. 6, the hook 21 is formed in such a manner that a portion of the right bracket member 14 is cut and partially projected from the right bracket member 14. If the user grasps the handle 12 formed on the subsidiary brush casing 11*a* and then raises it up, the right link 16 is rotated in a clockwise direction as illustrated in an arrow B in FIG. 8 while coming in contact with the inner side surface 14*b* of the right bracket member 14. When the right link 16 is rotated to some extent, it pushes down the hook 21 while climbing up an inclined portion 21*a* of the hook 21, as illustrated in FIG. 6. As a result, as illustrated in a dotted line in FIG. 6, the portion of the right bracket member 14 to which the hook 21 is formed is bent, so that the right link 16 crosses over the hook 21. After that, the right link 16 is blocked by the stopper 14*a* to stop moving, and the bent portion of the right bracket member 14 is returned to an original position by its own elastic force.

Figure 7:
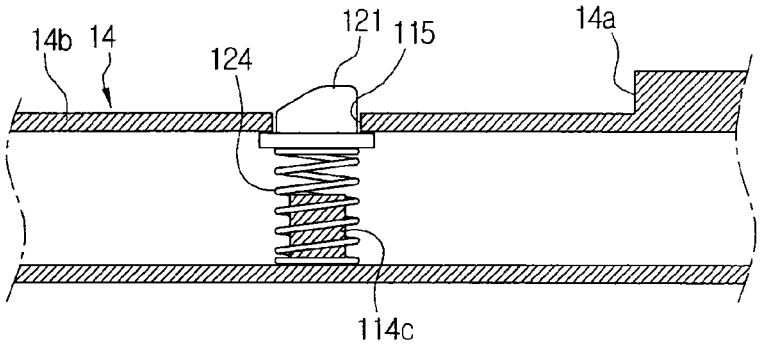
FIG. 7 is a cross-sectional view exemplifying another example of the hook of FIG. 6.

FIG. 7 illustrates another example of the hook. The hook 121 is inserted into and movably disposed in a penetrated hole 115 formed in the right bracket member 14, and is connected with a supporting projection 114*c* formed in the right bracket member 14 by a spring 124. That is, the spring 124 at one side thereof is supported around and fixed to the supporting projection 114*c*, and at the other side thereof is fixed to the hook 121. Accordingly, the spring 121 elastically urges the hook 121 in a direction where it is exposed out of the penetrated hole 115 formed in the right bracket member 14. Thus, if the right link member 16 climbs up and crosses over the hook 121, the hook 121 retreats into the right bracket member 14, so that the spring 124 is compressed. After that, when the right link 16 passes by the hook 121, the hook 121 is returned to an original position by an elastic force of the spring 124.

Figure 10:
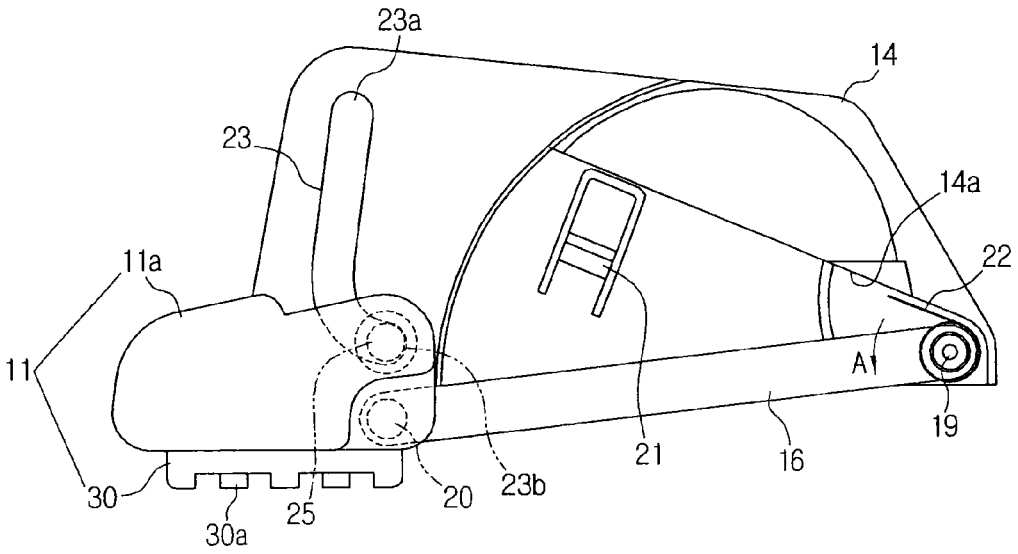
FIG. 10 is a view exemplifying only the subsidiary brush member, the right bracket member, and the right link of the subsidiary brush unit of the nozzle assembly of FIG. 1 when the subsidiary brush member is unfolded.

Referring to FIGS. 3 and 10, an elastic member 22 is installed on a first hinge axis 19, which connects the right link 16 with the right bracket member 14 (see FIG. 10). The elastic member 22 presses the right link 16 in a counterclockwise direction (see an arrow A in FIG. 10). Accordingly, if the right link 16 is positioned between the stopper 14*a* and the hook 21, the right link 16 are to rotate in the counterclockwise direction by the elastic member 22, but cannot be rotated in a reverse direction (a direction of the arrow A in FIG. 10) only by its own weight because it is hanged on a vertical portion 21*b* of the hook 21. Here, as the elastic member 22, a coil spring, a torsion spring, or the like may be used.

The left and the right links 15 and 16, which connect the subsidiary brush member 11 and the left and the right bracket members 13 and 14, respectively, are installed, so that both ends thereof are hinged to the subsidiary brush member 11 and the left and the right bracket members 13 and 14, respectively. That is, the right link 16 at one end thereof is rotatably assembled to the first hinge axis 19 installed on a lower end of the right bracket member 14 toward the nozzle assembly body 2, and at the other end thereof is rotatably assembled to the second hinge axis 20 installed in the vicinity of the guide member 25 (see FIG. 8). Also, the right link 16 is formed, so that when the user pushes down the handle 12 with her or his hand or foot, it can climbs up and cross over the hooks 21. The left link 15 has the same construction as that of the right link 16.

Hereinafter, an operation of the nozzle assembly 1 according to the first exemplary embodiment of the present disclosure constructed as described above will now be described in detail with reference to FIGS. 3, and 8 through 11.

Figure 11:
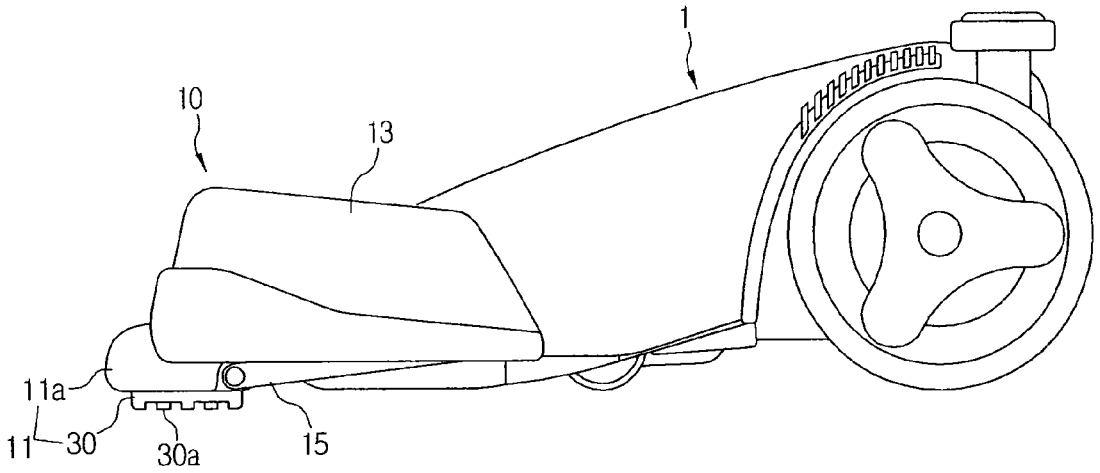
FIG. 11 is a side elevation view exemplifying the nozzle assembly of FIG. 1 when the subsidiary brush member is unfolded.

If the user wants to clean a carpet, she or he pushes down the handle 12 (see FIG. 1) installed on the subsidiary brush member 11 with her or his hand or foot. Then, the left and the right links 15 and 16 are rotated in a counterclockwise direction (see the arrow A) about the first hinge axis 19, as illustrated in FIG. 10. In this manner, with a pressing force of the user to the handle 12, the left and the right links 15 and 16 cross over the vertical portions 21*b* of the hooks 21 and move. As the left and the right links 15 and 16 are rotated downward as described above, the subsidiary brush member 11 is unfolded, as illustrated in FIGS. 10 and 11. Thus, after the left and the right links 15 and 16 cross over the hooks 21, they are rotated in the counterclockwise direction by their own weights and an elastic force of the elastic member 22 pressing them, even though the user does not additionally apply a force to the handle. At the same time, when the guide members 25 installed on both sides of the subsidiary brush member 11 are moved down along the left and the right guide grooves 23 formed on the left and the right bracket members 13 and 14 and then positioned to the bottoms 23*b* of the left and the right guide grooves 23, the subsidiary brush member 11 comes to a completely unfolded state as illustrated in FIGS. 10 and 11. That is, the subsidiary brush member 11 comes to a state where it is approximately parallel to the surface to be cleaned, that is, the carpet, by the left and the right link members 15 and 16 and the left and the right guide grooves 23 guiding the guide members 25. Also, since the elastic member 22 presses the left and the right links 15 and 16, the subsidiary brush member 11 is maintained in a state where it press the carpet in a certain force, and a friction force between a bottom of the subsidiary brush member 11 and the carpet is uniformly maintained.

In this state, if the user moves the nozzle assembly 1, the subsidiary brush 30 mounted below the subsidiary brush casing 11*a* scrapes against the carpet while contacting the carpet in a certain pressure, and thus separates a dust or dirt, such as hair, fur of a pet, or the like, tangled to the carpet therefrom. Then, the separated dust or dirt is drawn into the cleaner body through the dust inlet 7 of the body casing 3.

In case that a cleaning operation of the carpet is completed or there is no need to use the subsidiary brush member 11, the subsidiary brush member 11 is maintained in a folded state. If the user wants to fold the subsidiary brush member 11, she or he pushes up the handle (see FIG. 1) with her or his hand or foot. Then, the left and the right link members 15 and 16 are moved in a clockwise direction as illustrated in an arrow B in FIG. 8 about the first hinge axis 19, and the guide members 25 are moved in the clockwise direction along the left and the right guide grooves 23. As a result, the subsidiary brush member 11 begins to fold. When the left and the right links 15 and 16 are continuously moved in the clockwise direction to cross over the hooks 21, the subsidiary brush member 11 comes to a completely folded state. That is, after the left and the right links 15 and 16 climb up and cross over the hooks 21, the subsidiary brush member 11 comes to a state where it is approximately perpendicular to the surface to be cleaned, that is, the carpet, and the guide members 25 are positioned to the tops 23*a* of the left and the right guide grooves 23. Under this state, the nozzle assembly 1 according to the first exemplary embodiment of the present disclosure removes the dust or dirt by using only the drum brush 28 like the general nozzle assembly.

Second Embodiment

Figure 12:
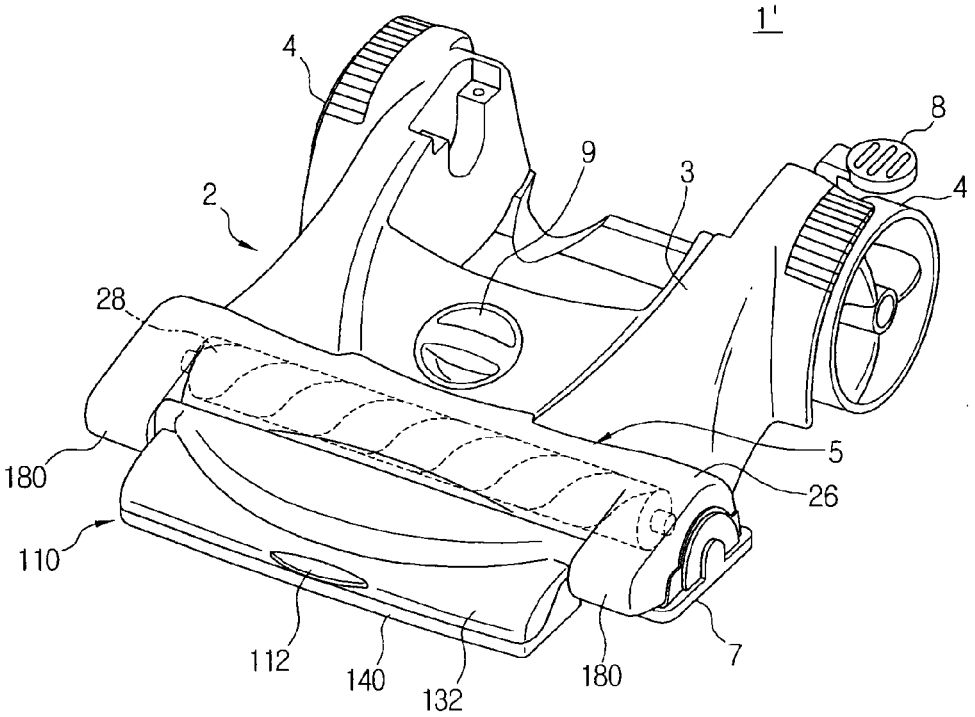
FIG. 12 is a perspective view exemplifying a nozzle assembly of a vacuum cleaner according to a second exemplary embodiment of the present disclosure.
Figure 13:
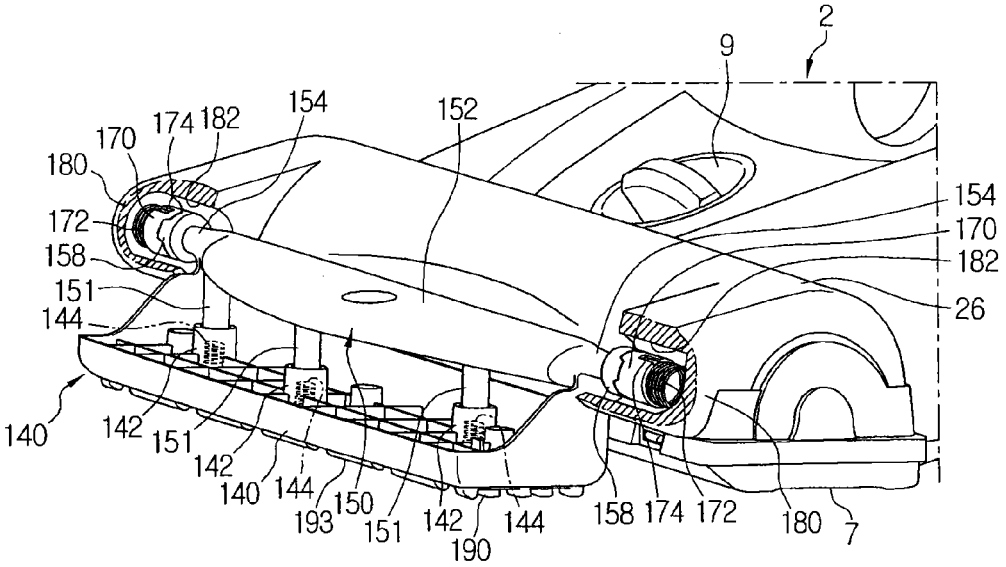
FIG. 13 is a perspective view exemplifying the nozzle assembly illustrated in FIG. 12 from which an upper casing of a subsidiary brush unit are removed.

FIG. 12 is a perspective view exemplifying a nozzle assembly 1' of a vacuum cleaner according to a second exemplary embodiment of the present disclosure, and FIG. 13 is a perspective view exemplifying the nozzle assembly 1' illustrated in FIG. 12 from which an upper casing 132 of a subsidiary brush unit 110 are removed and in which left and right bracket parts 180 are partially cut away, so that a lower casing 140 and a frame member 150 are shown in detail.

Referring to FIGS. 12 and 13, the nozzle assembly 1' according to the second exemplary embodiment of the present disclosure includes a nozzle assembly body 2, a drum brush unit 5, left and right bracket parts 80, cam members 170, first elastic members 172, and a subsidiary brush unit 110. Here, since constructions of the nozzle assembly body 2 and the drum brush unit 5 are the same as those of the nozzle assembly 1 of the first embodiment, detailed descriptions thereof will be omitted.

Figure 15:
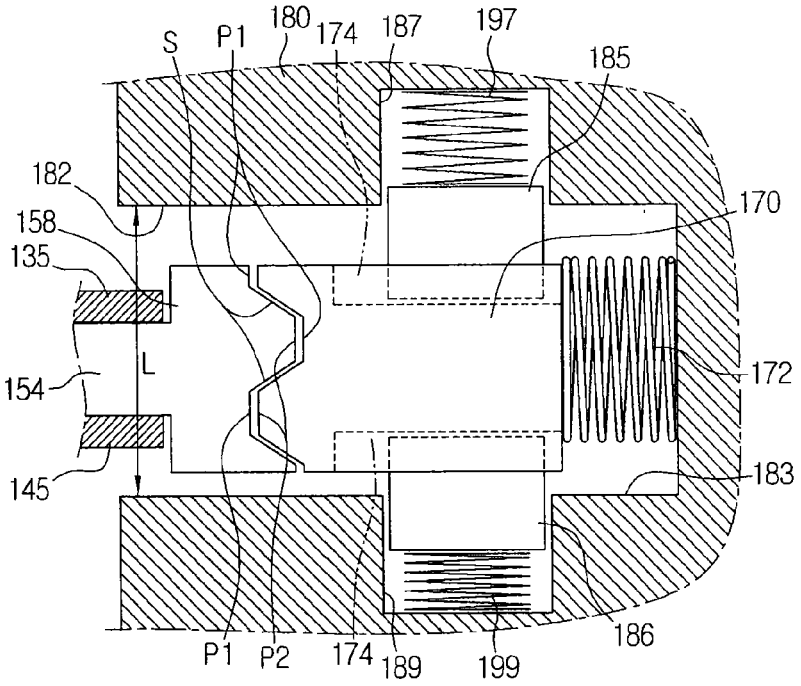
FIG. 15 is a schematic cross-sectional view exemplifying an operation of left and right bracket parts of the nozzle assembly when the subsidiary brush unit of the nozzle assembly is positioned in the state illustrated in FIG. 14.

The left and right bracket parts 180 are projected forward in front of both sides of the drum brush casing 26, respectively, and supports the subsidiary brush unit 110. The left and right bracket parts 180 are integrally formed with the drum brush casing 26. However, alternatively, the left and right bracket parts 180 can be separately formed from the drum brush casing 26. Referring to FIGS. 13 and 15, elongated holes 182 in which both ends of a frame axis 154 of the subsidiary brush unit 110 are inserted, respectively, are formed in the left and right brackets parts 180, respectively. The elongated holes 182 are elongatedly formed in an up-and-down direction, and a first elastic member 172 and a cam member 170 are installed in each of the elongated holes 182. The first elastic members 172 are fixed to ends of inner walls of the elongated holes 182 to press the cam members 170, respectively. Referring to FIG. 15, upper and lower guide grooves 187 and 189 are formed in intervals of 180° in each of the inner walls of the elongated holes 182. In the upper and lower guide grooves 187 and 189 are mounted an upper key 185 and an upper coil spring 197, and a lower key 186 and a lower coil spring 199, respectively. The upper and the lower coil spring 197 and 199 press the upper and the lower keys 185 and 186 into the corresponding elongated hole 182. Accordingly, when the cam members 170 are moved upward, the upper keys 185 are further inserted into the upper guide grooves 187 by the cam members 170 to compress the upper coil springs 197, and the lower keys 186 are further protruded out of the lower guide grooves 189 by pressing forces of the lower coil springs 199. To the contrary, when the cam members 170 are moved downward, the upper keys 185 are further protruded out of the upper guide grooves 187 by their own eights and pressing forces of the upper coil springs 197, and the lower keys 186 are further inserted into the lower guide grooves 189 by pressing forces of the cam members 170 to compress the lower coil springs 199.

Referring to FIGS. 13 and 15, each of the cam members 170 is formed in a cylindrical shape, one side of which is flat and the other side of which has furrows P1, threads P2, and inclined portions S connecting the furrows P1 and the threads P2 formed in a circumferential direction thereof like one side of each of uneven parts 158 of the frame axis 154. The one side of the cam member 170 comes in contact with the corresponding first elastic member 172, and the other side of the cam member 170 engages with the corresponding uneven part 158 of the frame axis 154. Two key grooves 174 are formed in a longitudinal direction in intervals of 180° on an outer circumferential surface of each of the cam members 170, so that the upper and the lower keys 185 and 186 are inserted therein, respectively. Accordingly, even though the uneven parts 158 are rotated, the keys 185 and 186 and the key grooves 174 are engaged with each other to restrain rotations of the cam members 170. As a result, the cam members 170 are not rotated, but moved in a horizontal direction as the inclined portions S of the cam members 170 and the uneven parts 158 are slid to each other.

The drum brush 28 is disposed in the vicinity of the dust inlet 7 in the drum brush casing 26 (see FIG. 12). Accordingly, when the drum brush 28 is rotated, a blade or a brush member, which is formed on an outer circumferential surface of the drum brush 28, scrapes against a surface to be cleaned.

Referring to FIG. 12, the subsidiary brush unit 110 is installed to connect with the left and right bracket parts 180. That is, the subsidiary brush unit 110 is rotatably and detachably mounted to the drum brush casing 26 in front thereof, so that it preliminarily brushes away dust or dirt from the surface to be cleaned in front of the drum brush 28. Referring to FIGS. 12 and 13, the subsidiary brush unit 110 includes an upper casing 132, a lower casing 140, a frame member 150, a subsidiary brush 190, and second elastic members 144.

The upper casing 132 and the lower casing 140 are joined with each other while interposing the frame member 150 therebetween to wrap the frame axis 154 of the frame member 150. Accordingly, the upper casing 132 and the lower casing 140 are rotated and moved along with the frame axis 154 (see FIGS. 13 and 15). Referring to FIG. 12, a handle 112 is disposed in front of an upper surface of the upper casing 132. Referring to FIG. 13, three bosses 142 are formed in the lower casing 140, and the second elastic members 144 are mounted in the bosses 142.

Referring to FIGS. 13 and 15, the frame member 150 includes a frame body 152, frame keys 151, a frame axis 154, and uneven parts 158. As illustrated in FIG. 13, the frame body 152 forms a middle portion of the frame member 150 to which the frame axis 154 and the frame keys 151 are integrally connected. The frame keys 151 are configured, so that three frame keys are formed in a cylindrical shape and projected downward from an undersurface of the frame body 152. The frame keys 151 are inserted into the bosses 142 of the lower casing 140, so that they compresses the second elastic members 144 mounted in the bosses 142. Accordingly, weights of the frame member 150 and the upper casing 132 are elastically transmitted to the lower casing 140, and thus the subsidiary brush 190 disposed on an undersurface of the lower casing 140 scrapes off the dust or dirt adhered to the surface to be cleaned while pressing the surface to be cleaned in a certain pressure. The frame axis 154 is projected from both sides of the frame body 152, and the uneven parts 158 are formed on both ends of the frame axis 154, respectively. The uneven parts 158 are inserted into the elongated holes 182 of the left and right bracket parts 180, so that they can rotate while engaging with the cam members 170 and move in the elongated holes 182, respectively.

The subsidiary brush 190 is formed of a rubber material, and detachably mounted on the undersurface of the lower casing 140. Referring to FIG. 13, the subsidiary brush 190 is made up of a plurality of projections 193.

Hereinafter, an operation of the nozzle assembly 1' according to the second exemplary embodiment of the present disclosure constructed as described above will now be explained with reference to FIGS. 14 through 18.

Figure 14:
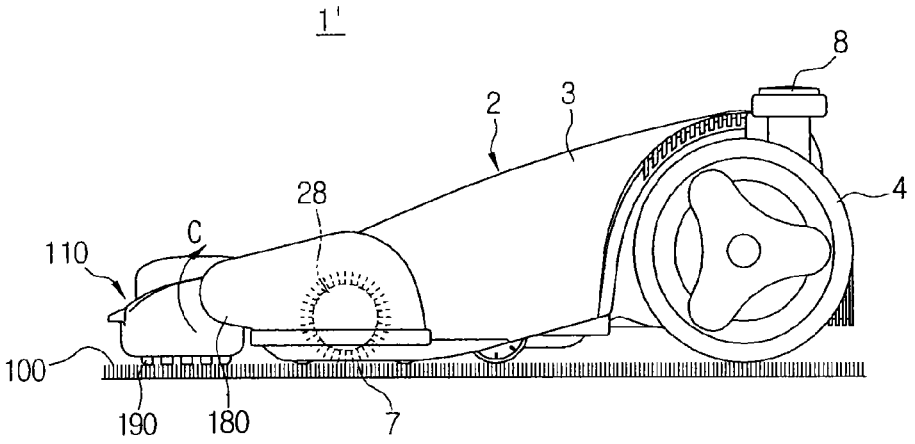
FIG. 14 is a side elevation view exemplifying a cleaning state, that is, an use state, of the subsidiary brush unit of the nozzle assembly illustrated in FIG. 12 where it comes in contact with a surface to be cleaned.

FIGS. 14 and 15 illustrate a use state of the subsidiary brush unit 110 where it comes in contact with the surface to be cleaned. When the subsidiary brush 190 of the subsidiary brush unit 110 comes in close contact with the surface to be cleaned to clean the surface to be cleaned, as illustrated in FIG. 14, it scrapes against the surface to be cleaned while pressing the surface to be cleaned in a certain pressure by weights of the frame member 150 and the upper casing 132 disposed above the subsidiary brush 190. Dust or dirt, such as hair or the like, adhered to the surface to be cleaned are preliminarily scraped off by the subsidiary brush unit 110 in front of the drum brush 28 (see FIG. 12), again scattered by the drum brush 28 mounted in the drum brush casing 26, and then drawn in through the dust inlet 7. In this manner, the frame axis 154 and the cam members 170 inserted into the elongated holes 182 are inclined to bottom surface 183 of the inner walls of the elongated holes 182. In addition, the upper keys 851 mounted in the upper guide grooves 187 are protruded out thereof by the upper coil springs 197, and the lower keys 186 are further inserted inside of the lower guide grooves 189 due to weights of the cam members 170 to compress the lower coil spring 199. Also, the first elastic members 172 are relaxed, and the uneven parts 158 and the cam members 170 are secured to each other in a state where the furrows P1 and the threads P2 thereof are engaged with each other. Since the cam members 170 cannot be rotated, the frame axis 154 is not rotated as so far as an external force is not applied thereto. Accordingly, the subsidiary brush unit 110 is not rotated, but maintained in the state where it comes in contact with the surface to be cleaned. Here, a length L represents a diameter o the elongated holes 182.

Figure 16:
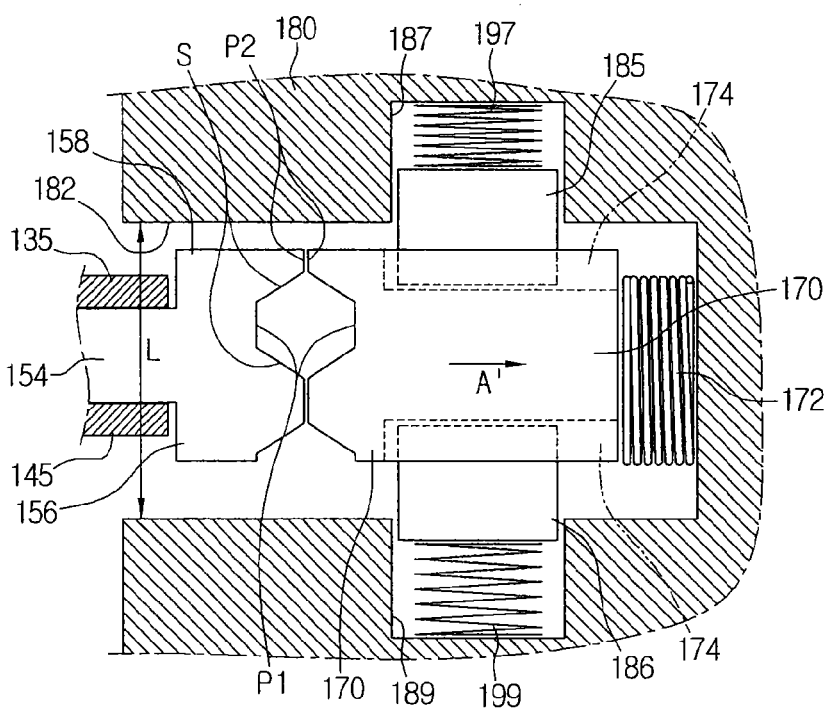
FIG. 16 is a schematic cross-sectional view exemplifying the left and the right bracket parts when the subsidiary brush unit is rotated at an angle of approximately 45° from the use state illustrated in FIG. 14.

If a user grasps the handle 112 of the upper casing 132 and then rotates the subsidiary brush unit 110 by an angle of 45° in a direction of arrow C in FIG. 14, the frame axis 154 and the uneven parts 158 are rotated in the same direction. However, since the upper and the lower keys 185 and 186 restrains the cam members 170 from being rotated, the inclined portions S of the cam members 170 and the uneven parts 158 are slid to each other, and thus the furrows P1 and the threads P2 thereof are in contact with each other, as illustrated in FIG. 16. As a result, the cam members 170 moves by a height of the threads P2 of the uneven parts 158 in a direction of arrow A' in FIG. 16 while compressing the first elastic members 172. Since the upper casing 132 and the frame member 150 pressing the lower casing 140 also incline in an angle of approximately 45°, the frame member 150 is lifted a little in the elongated holes 182 by pressing forces of the second elastic members 144 mounted in the bosses 142 (see FIG. 13), which presses the frame keys 151. The cam members 170, which are engaged with the frame member 150, are also lifted in the same height.

Figure 17:
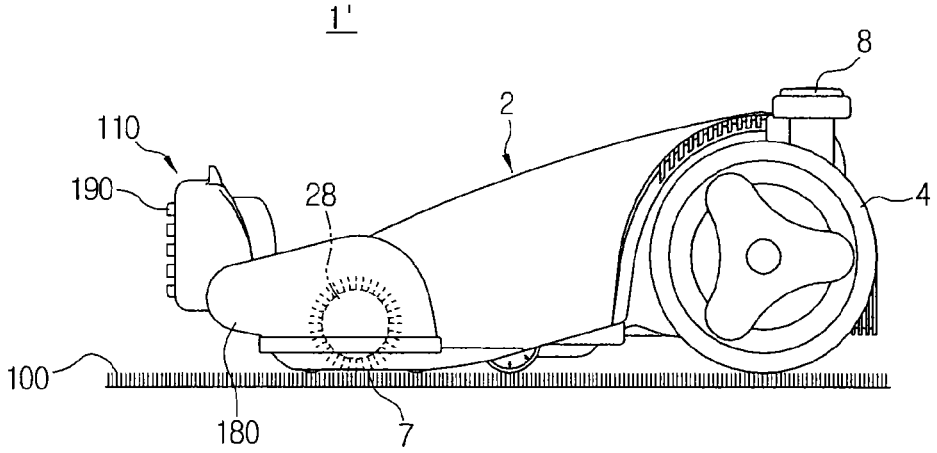
FIG. 17 is a side elevation view exemplifying a non-cleaning state, that is, a non-use state of the subsidiary brush unit of the nozzle assembly illustrated in FIG. 12 where it is rotated to form an angle of approximately 90° to the surface to be cleaned.
Figure 18:
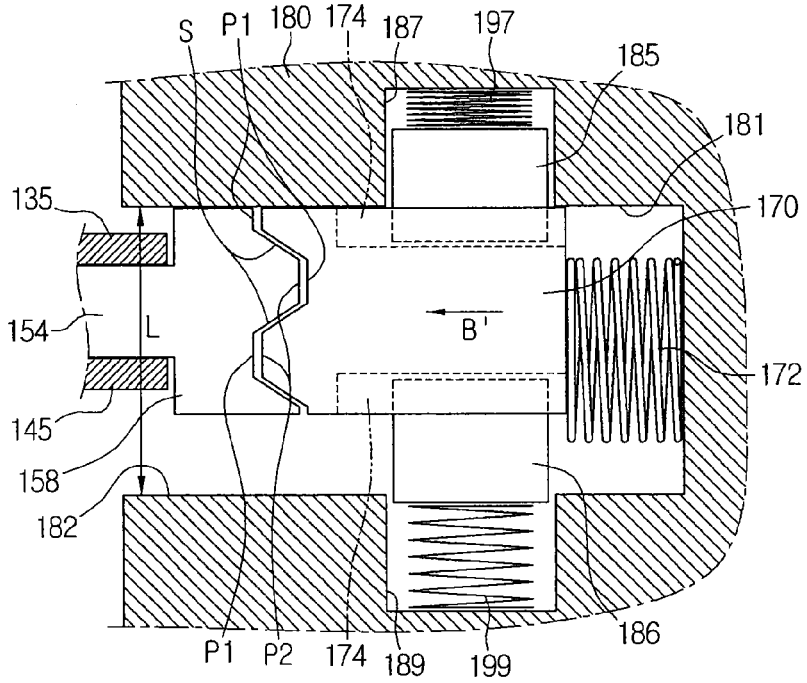
FIG. 18 is a schematic cross-sectional view exemplifying an operation of the left and the right bracket parts of the nozzle assembly when the subsidiary brush unit of the nozzle assembly is positioned in the state illustrated in FIG. 17.

If the subsidiary brush unit 110 is further rotated to reach a vertical state, as illustrated in FIG. 17, the cam members 170 are moved in a direction of arrow B' by the first elastic members 172, and thus the cam members 170 and the uneven parts 158 are secured to each other in the elongated holes 182, as illustrated in FIG. 18. Since the furrows P1 of the cam members 170 and the threads P2 of the uneven parts 158 are engaged with each other and the cam members 170 are not rotated by the upper and the lower keys 185 and 186, the uneven parts 158, which are engaged with the cam members 170, are also not rotated as so far as an external force is not applied thereto. As the subsidiary brush unit 110 almost reaches the vertical state, the weights applied to the lower casing 140 by the upper casing 132 and the frame member 150 are removed. As a result, the cam members 170 and the uneven parts 158 come in close contact with top surfaces 181 of the inner walls of the elongated holes 182 by the first elastic members 144 mounted in the bosses 142 of the lower casing 140.

Third Embodiment

FIGS. 19 through 23 are views exemplifying a nozzle assembly 1" of a vacuum cleaner according to a third exemplary embodiment of the present disclosure.

Figure 19:
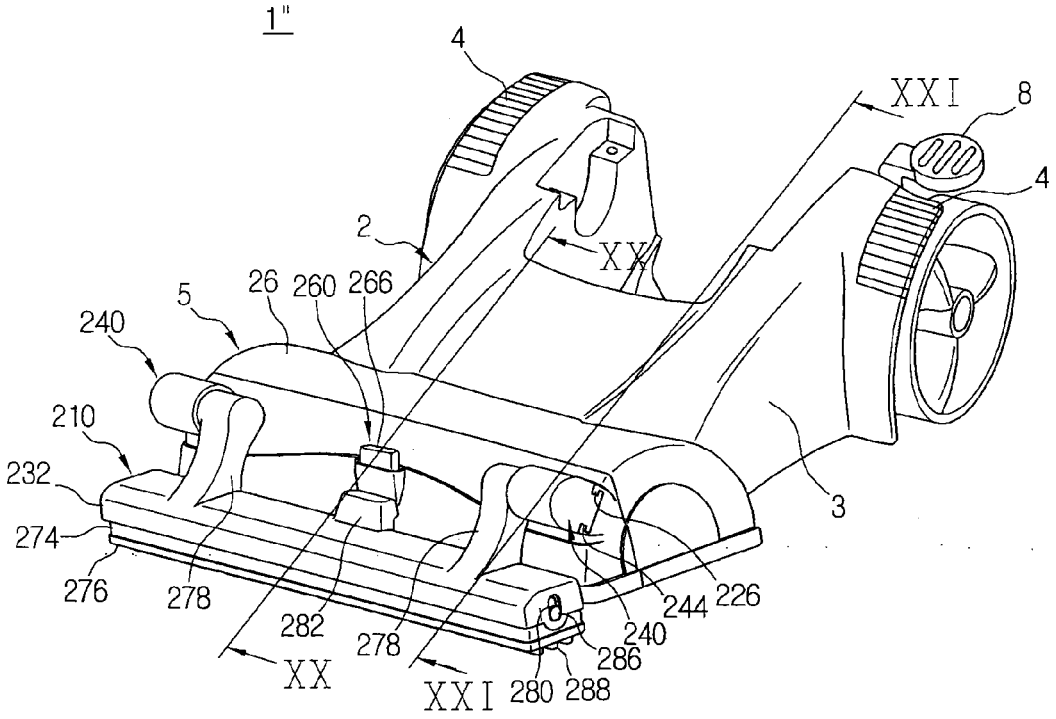
FIG. 19 is a perspective view exemplifying a nozzle assembly of a vacuum cleaner according to a third exemplary embodiment of the present disclosure.

Referring to FIG. 19, the nozzle assembly 1" of the third exemplary embodiment includes a nozzle assembly body 2, a drum brush unit 5, left and right brackets 240, a locking unit 260, and a subsidiary brush unit 210. Here, since constructions of the nozzle assembly body 2 and the drum brush unit 5 are the same as those of the nozzle assemblies 1 and 1' of the first and the second exemplary embodiments, detailed description thereof will be omitted.

The drum brush casing 26 has two sliding rails 226 (see FIG. 23) disposed on both sides in front thereof, and a mounting space 221 (see FIG. 20) disposed in the middle in front thereof. In the sliding rails 226 are mounted the left and right brackets 240, respectively, and in the mounting space 221 is installed a locking member 260. As illustrated in FIG. 21, the sliding rails 226 are inserted into sliding grooves 244 of the left and right brackets 240, so that they are connected with the left and right brackets 240. That is, when the sliding rails 226 are inserted into the sliding grooves 244 of the left and right brackets 240 and moved in a longitudinal direction of the sliding rails 226, the left and right brackets 240 are mounted on the drum brush casing 26. Under this state, when the sliding rails 226 are moved in a direction opposite to the mounting direction, the left and right brackets 240 are separated from the drum brush casing 26. Accordingly, it is easy to mount the left and right brackets 240 on the drum brush casing 26 or separate the left and right brackets 240 from the drum brush casing 26. Alternatively, after the left and right brackets 240 is mounted on the drum brush casing 26 though the sliding rails 226 and the sliding grooves 244, they can be fixed to the drum brush casing 26 with screws (not illustrated) or hook members (not illustrated). In this case, if a fastening by the screws or a locking by the hook members is released, the left and right brackets 240 can be removed from the drum brush casing 26, thereby allowing the subsidiary unit 210 to repair or replace.

Figure 23:
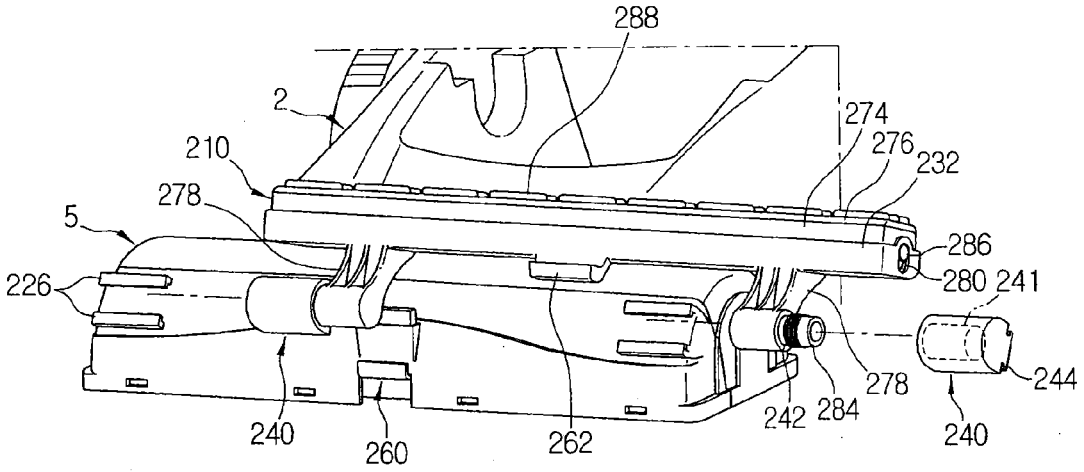
FIG. 23 is a perspective view of the nozzle assembly of FIG. 19 in which the subsidiary brush unit is separated and disassembled from the drum brush unit.

Referring to FIGS. 21 and 23, each of the left and right brackets 240 is provided with a mounting groove 241, a sliding groove 244 and a spring 242. As described above, the left and right brackets 240 are mounted on the drum brush casing 26, and two cover arms 278 of the subsidiary brush casing 232 are coupled to the left and right brackets 240, respectively. The mounting groove 241 is formed in a longitudinal direction from one side of each of the left and right brackets 240. In the mounting groove 241 is disposed the spring 242. Also, in the mounting groove 241 is inserted and disposed a cover axis 284 of the subsidiary brush casing 232.

Figure 22:
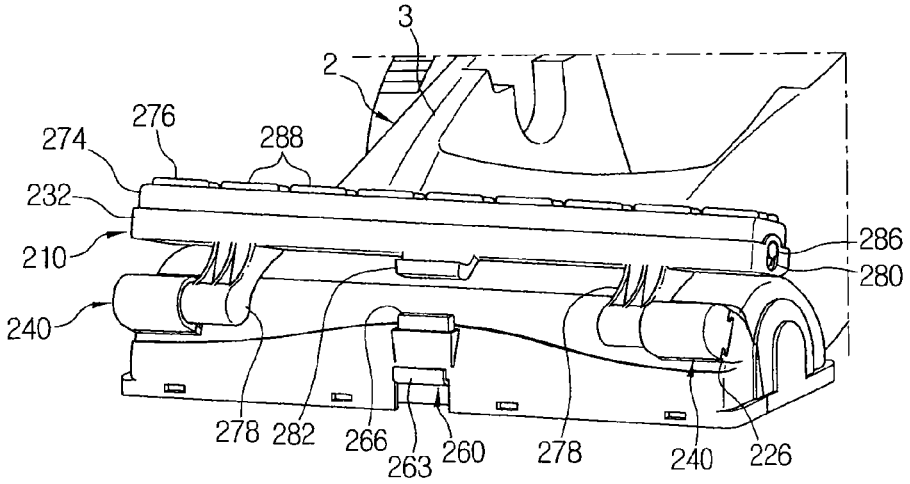
FIG. 22 is a perspective view of the nozzle assembly of FIG. 19 in which a subsidiary brush unit is rotated and positioned over a drum brush casing (a non-use state)

The sliding groove 244 is formed in a longitudinal direction on upper and lower sides of each of the left and right brackets 240, and the sliding rail 226 is inserted in the sliding groove 244. The spring 242 is installed in the mounting groove 241 of each bracket 240 into which the cover axis 284 of the subsidiary brush casing 232 is inserted. That is, the spring 242 at one side thereof is fixed to each bracket 240 and at the other side thereof is fixed to the cover arm 278. The spring 242 elastically urges the subsidiary brush casing 232 in an upward direction, that is, in a direction of rotating it to an upper end of the drum brush casing 26, as illustrated in FIG. 22.

Figure 20:
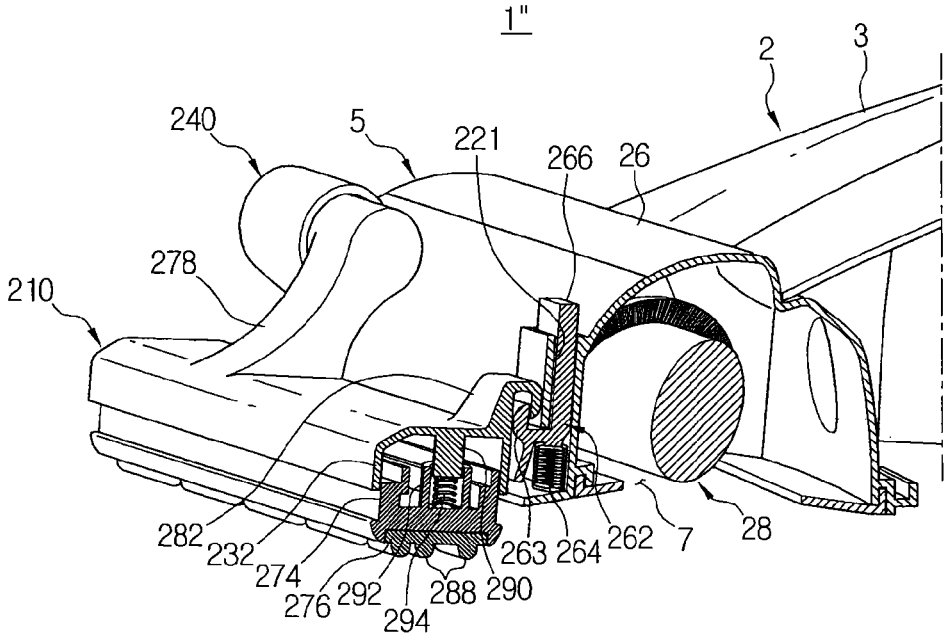
FIG. 20 is a perspective view of the nozzle assembly taken along line XX-XX of FIG. 19.
Figure 21:
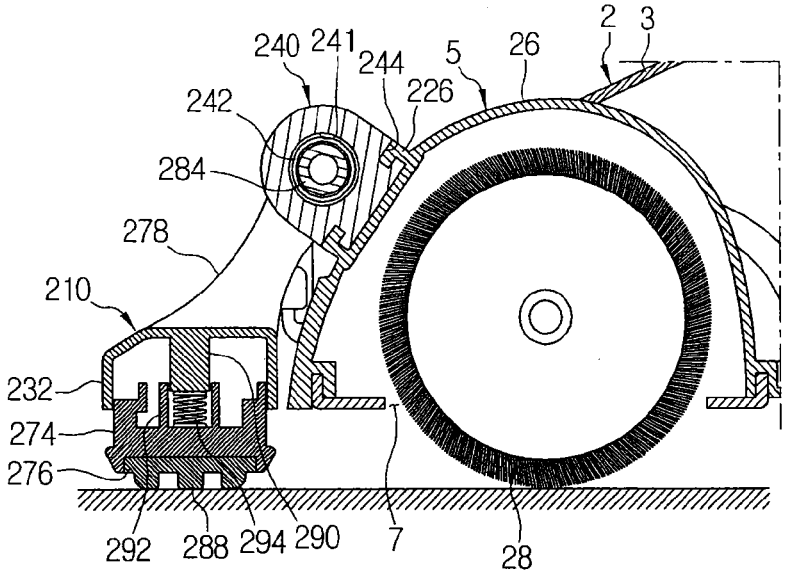
FIG. 21 is a cross-sectional view of the nozzle assembly taken along line XXI-XXI of FIG. 19.

Referring to FIGS. 19 and 20, the locking unit 260 is disposed in the mounting space 221 of the subsidiary brush casing 232, and includes a hook member 262 and a spring 264. To move in upward and downward directions, the hook member 262 has an outwardly projected protrusion, that is, a button 266, at an upper part thereof and a retaining part 263 at a lower part thereof. The retaining part 263 is engaged with a locking part 282 of the subsidiary brush casing 232. The spring 264 is disposed in a lower part of the mounting space 221, and urges the hook member 262 in an upward direction.

Referring to FIGS. 19 through 21, the subsidiary brush unit 210 includes a subsidiary brush casing 232, a panel 274, and a subsidiary brush 276.

The subsidiary brush casing 232 has two cover arm 278 inclinedly projected upward from both sides of an upper surface thereof, and the cover arms 278 have cover axes 284 (seen FIG. 23) integrally formed with and horizontally projected from one end thereof. The cover arms 278 are elastically urged in the upward direction by the springs 242 installed in the left and right brackets 240, respectively.

Referring to FIGS. 20 and 21, the subsidiary brush casing 232 has a plurality of keys 290 projected downward from an undersurface thereof.

Referring to FIGS. 19 through 21, the panel 274 is joined to a lower end of the subsidiary brush casing 232, so that it is elastically movable up and down and rotatable. The panel 274 at an upper surface thereof has a plurality of bosses 292, each of in that a spring 294 is installed. The plurality of keys 290 of the subsidiary brush casing 232 is inserted in the bosses 292, and is urged in an upward direction by the springs 294 in the bosses 292, respectively. Also, as illustrated in FIG. 19, panel axes 286 of the panel 274 are inserted in elongated holes 280 in both side surfaces of the subsidiary brush casing 232, so that the panel 274 can be rotated with respect to the subsidiary brush casing 232. Accordingly, even though a surface to be cleaned is crooked or irregular, the panel 274 presses the surface to be cleaned in a certain pressure while being elastically moved up and down and rotated. In the middle of the upper surface of the subsidiary brush casing 232 is formed the locking part 282. The locking part 282 is locked to the retaining part 263 of the hook member 262.

Referring to FIGS. 20 and 21, the subsidiary brush 276 is formed of a rubber material to have elasticity, and has a plurality of protrusions 288 projected downward from an undersurface thereof. Each of the protrusions 288 may be configured to have various shapes, such as a cylinder, an oval with a rounded tip, etc. The protrusions 288 scrapes against hair or fur of a pet adhered to the surface to be cleaned to separate it therefrom and thus to fly it in all directions. The subsidiary brush 276 is fixed to an undersurface of the panel 274, but since the panel 274 is configured to be movable up and down and rotatable with respect the subsidiary brush casing 232, the subsidiary brush 276 can be movable up and down and rotatable with respect the subsidiary brush casing 232.

Hereinafter, an operation of the nozzle assembly 1" of the vacuum cleaner according to the third embodiment of the present disclosure will be explained in detailed with reference to FIGS. 19 through 23.

If a user wants to use the subsidiary brush unit 210 to clean a portion of a quilt or carpet to that the dirt, such as the hair or the fur of the pet, is adhered, she or he pushes down the subsidiary brush unit 210 against an elastic force of the springs 242 with her or his hand or foot to allow the subsidiary brush unit 210 to come in contact with the surface to be cleaned, as illustrated in FIG. 19, the locking part 282 of the subsidiary brush casing 232 is locked to the retaining part 263 of the hook member 262. As a result, the subsidiary brush unit 210 is fixed in a use position to the drum brush unit 5 by the locking unit 260. In this manner, the user moves the nozzle assembly 1" onward, so that the protrusions 288 of the subsidiary brush 276 comes in contact with the surface to be cleaned, that is, the carpet, to scrape against the dirt, such as the hair or the fur, tangled to the carpet and thus to preliminarily separate the dirt therefrom, and the drum brush 28 strikes the carpet again to fly the dirt in all directions and thus to draw in it through the dirt inlet 7. Since the bosses 292 of the panel 274 and the keys 290 of the subsidiary brush casing 232 are elastically coupled with each other and the panel axes 286 are movably and rotatably connected in the elongated holes 280 of the subsidiary brush casing 232, the panel 274 scrapes against the carpet while elastically moving up and down and rotating with respect to subsidiary casing 232 and thus coming in well contact with the carpet.

If the user does not temporarily want to use the subsidiary brush unit 210, she or he pushes the button 266 of the hook member 262 in a downward direction, and thus releases the locking connection between the locking part 282 of the subsidiary brush casing 232 and the retaining part 263 of the hook member 262. The subsidiary brush unit 210 separated from the drum brush unit 5 is moved to an upper part of the drum brush casing 26 by a pressing force of the springs 242 installed in the left and right brackets 240, as illustrated in FIG. 22 (non-use position). If the user does not push again the subsidiary brush unit 210 in the downward direction, the subsidiary brush unit 210 is maintained in the non-use position illustrated in FIG. 22 by the pressing force of the springs 242 installed in the left and right brackets 240.

If the subsidiary brush unit 210 is not to be used for a long time, or is to be maintained or repaired, the user moves the left and right brackets 240 in a horizontal direction to the sliding rails 266 to disassemble the subsidiary brush unit 210 from the drum brush unit 5. The separated subsidiary brush unit 210 is separately kept, and only the drum brush 28 is used in cleaning. To assemble the subsidiary brush unit 210 to the drum brush casing 26 again, the user inserts the sliding rails 226 into the sliding grooves 244 of the left and right brackets 240 and then moves the subsidiary brush unit 210 in a direction reverse to the disassembling direction.

Fourth Embodiment

FIGS. 24 through 33 shows a nozzle assembly 1' of a vacuum cleaner according to a fourth embodiment of the present disclosure.

Figure 24:
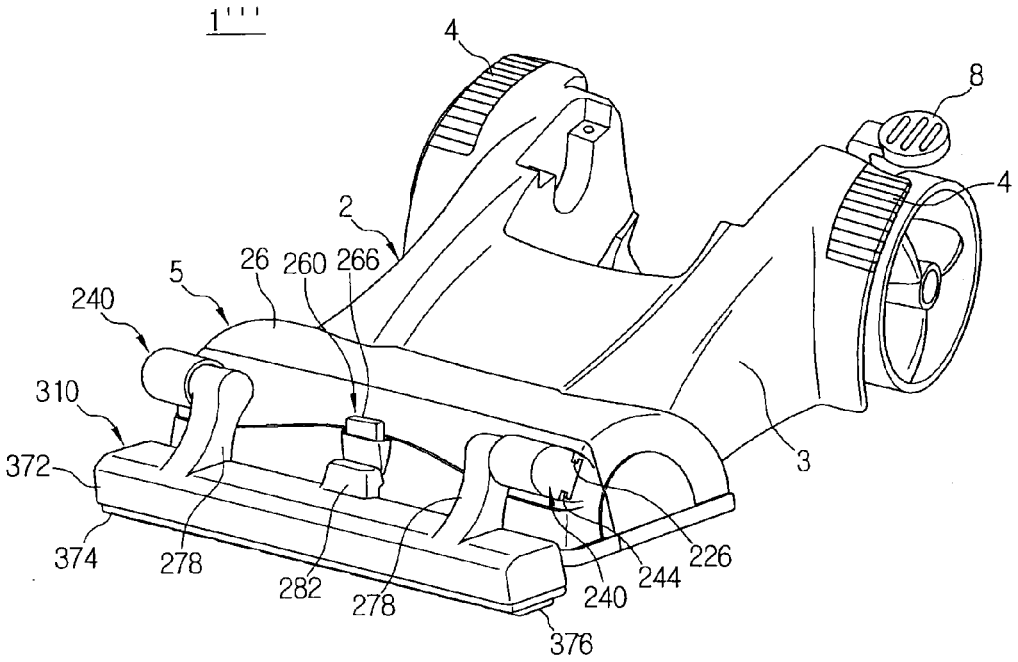
FIG. 24 is a perspective view exemplifying a nozzle assembly of a vacuum cleaner according to a fourth exemplary embodiment of the present disclosure.

Referring to FIG. 24, the nozzle assembly 1' of the fourth embodiment includes a nozzle assembly body 2, a drum brush unit 5, left and right brackets 240, a locking unit 260, and a subsidiary brush unit 310. Since a construction of the nozzle assembly 1' of the fourth embodiment except the subsidiary brush unit 310 is the same as that of the nozzle assembly 1" of the third embodiment, a detailed description thereof will be omitted.

Figure 25:
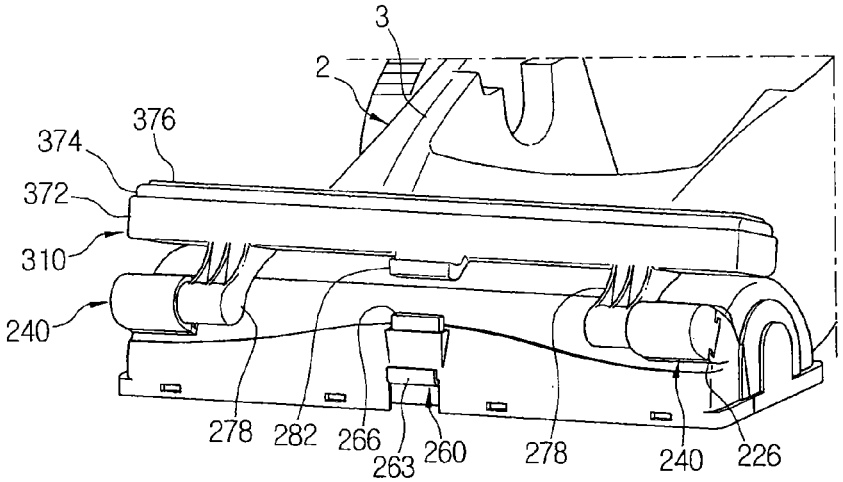
FIG. 25 is a perspective view of the nozzle assembly of FIG. 24 in which a subsidiary brush unit is rotated and positioned over a drum brush casing (a non-use state)

Referring to FIGS. 24 and 25, the subsidiary brush unit 310 includes a subsidiary brush casing 372, a panel 374, and a subsidiary brush 376.

The subsidiary brush casing 372 has two cover arm 278 inclinedly projected upward from both sides of an upper surface thereof, and rotatably installed in the left and right bracket 240. The cover arms 278 are elastically urged in an upward direction by springs installed in the left and right brackets 240, respectively. Also, as illustrated in FIG. 28, the subsidiary brush casing 372 has two fixing bosses 373 formed on both sides of an undersurface thereof to fix first and second hinge brackets 380 (one shown in FIGS. 26A through 26C and 31) to be described later.

Figure 26A:
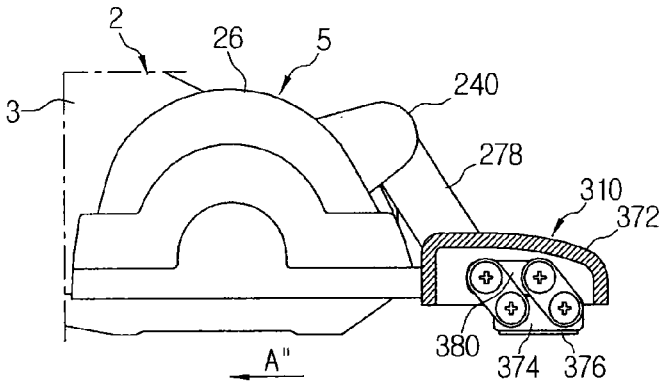
FIGS. 26A, 26B and 26C are partial cross-sectional views exemplifying an operation of the nozzle assembly of FIG. 24.
Figure 26B:
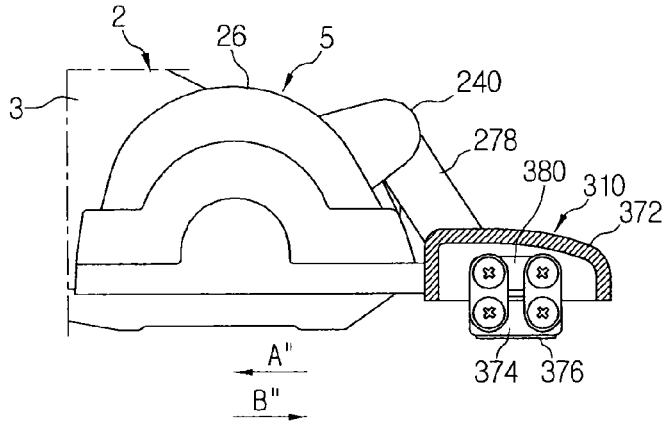
Figure 26C:
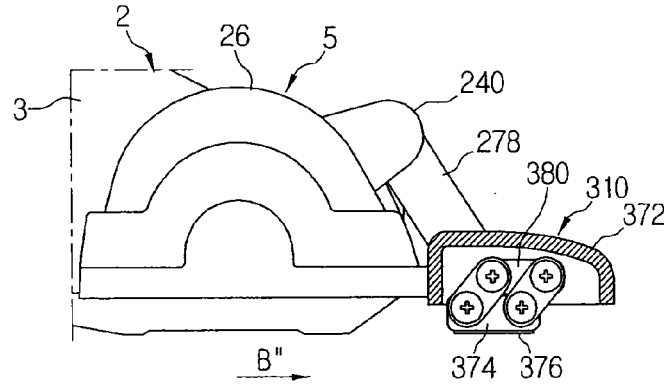
Figure 29:
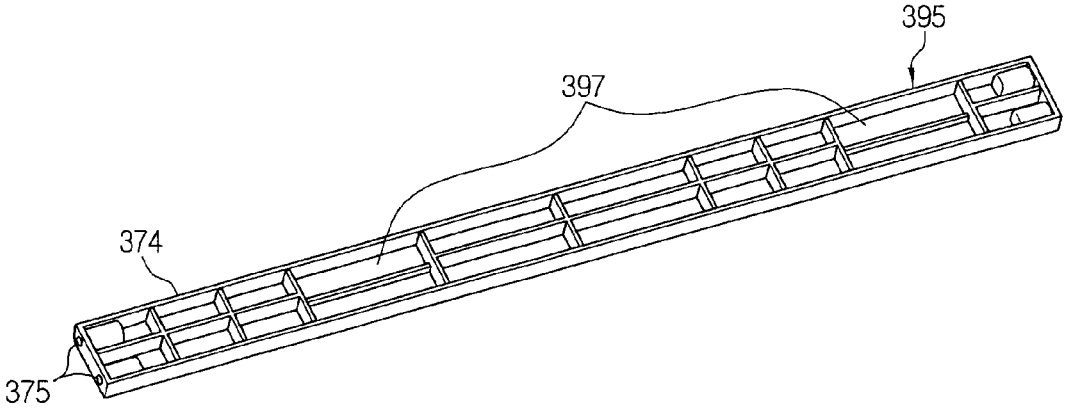
FIG. 29 is a perspective view exemplifying an upper surface of a subsidiary brush of the subsidiary brush unit of the nozzle assembly illustrated in FIG. 27.
Figure 31:
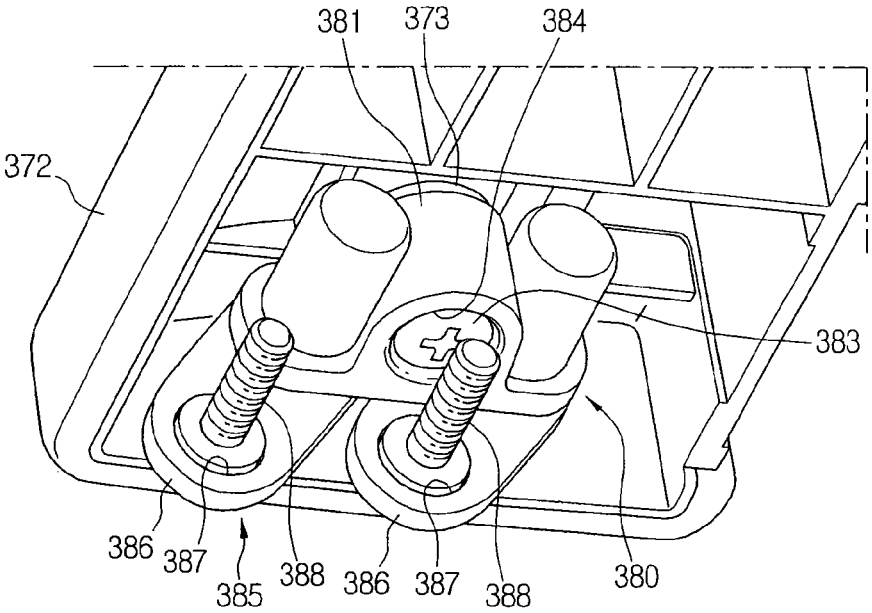
FIG. 31 is a perspective view exemplifying a hinge bracket, which hingedly connects the subsidiary brush of FIG. 27 to the subsidiary brush casing.
Figure 32:
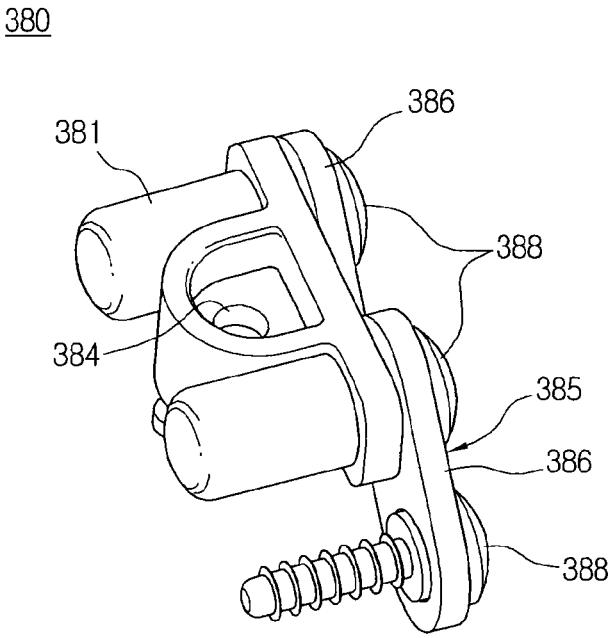
FIG. 32 is a perspective view of the hinge bracket illustrated in FIG. 31.
Figure 33:
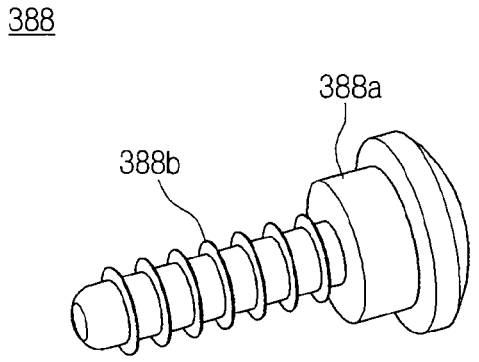
FIG. 33 is a perspective view exemplifying a hinge screw, which hingedly fixes a link member of the hinge bracket illustrated in FIG. 32.

As illustrated in FIGS. 26A through 26C, the panel 374 is configured to be movable back and forth and in a horizontal direction with respect to the subsidiary brush casing 372. For this, first and second hinge brackets 380 are disposed between both side ends of the panel 374 and the subsidiary brush casing 372 to hingedly fix the panel 374 to the subsidiary brush casing 372. Referring to FIGS. 31 and 32, each of the first and second hinge brackets 380 is formed of a body 381 and a link member 385. The body 381 at the middle thereof has a penetrated hole 384 into which a screw 383 is inserted. The screw 383 is fixed to the corresponding fixing boss 373 of the subsidiary brush casing 372. In addition, the body 381 has two screw holes (not illustrated) formed in a direction perpendicular to the penetrated hole 384 at both sides of the penetrated hole 384. In the screw holes are fixed screw portions 388*b* of hinge screws 388 to be described later, respectively. The link member 385 is formed of two link 386, each of which has two hinge holes 387 formed at both ends thereof and hinged by two hinge screws 388. As illustrated in FIG. 33, each of the hinge screws 388 has a raised portion 388*a* rotatably supported in one of the hinge holes 387 of the link 386, and a screw portion 388*b* screwed to one of screw holes 375 (see FIG. 29) of the panel 374 or one of the screw holes of the body 381. As illustrated in FIG. 29, the screw holes 375 of the panel 374 are formed at both ends of the panel 374. Accordingly, as illustrated FIGS. 26A through 26C, when the nozzle assembly body 2 of the nozzle assembly 1''' is moved back and forth by a user, each of the links 386 of the link member 385 of the first and the second hinge brackets 380 at both ends thereof is pivoted to the body 381 and the panel 374, and thus the panel 374 and the subsidiary brush 376 fixed thereto can be moved back and forth and in the horizontal direction.

Figure 30:
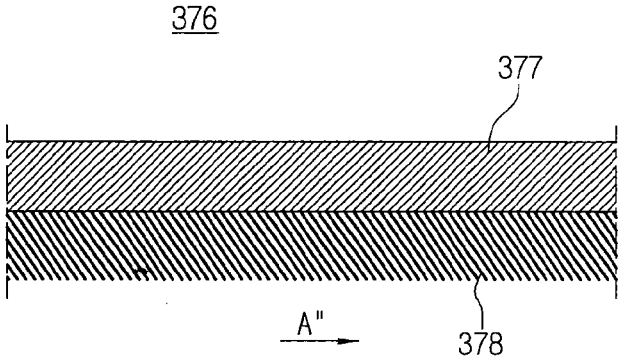
FIG. 30 is a partial cross-sectional view exemplifying a picker attached on a undersurface of the subsidiary brush illustrated in FIG. 29.

The subsidiary brush 376 is made up of a picker 377 adhered on an undersurface of the panel 374. The picker 377 may be formed of a wool, cloth, or fabric with shag. As illustrated in FIG. 30, the picker 377 is preferably formed, so that a shag portion 378 thereof has a texture inclined in one direction, for example, a direction toward the drum brush unit 5 to scrape off dust or dirt toward the drum brush unit 5 when the nozzle assembly body 2 of the nozzle assembly 1' is pulled in a direction arrow A" as illustrated in FIG. 26A.

Figure 27:
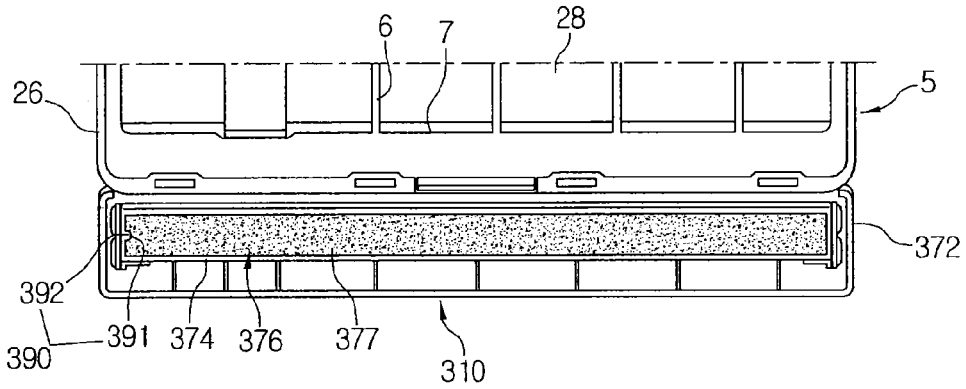
FIG. 27 is a perspective view exemplifying a undersurface of the nozzle assembly of FIG. 24.
Figure 28:
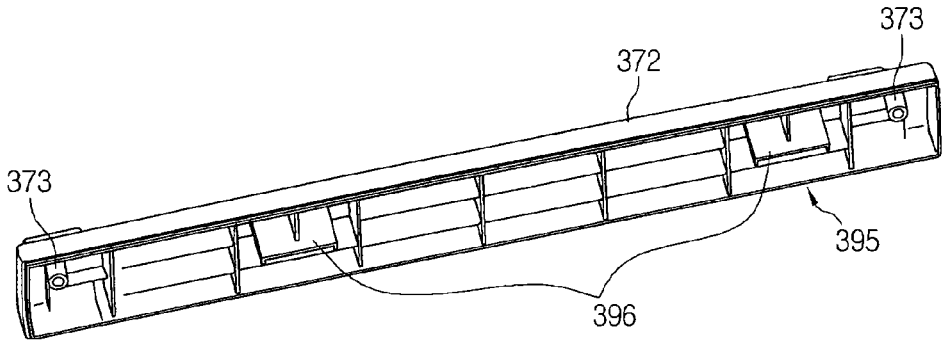
FIG. 28 is a perspective view exemplifying a undersurface of a subsidiary brush casing of the subsidiary brush unit of the nozzle assembly illustrated in FIG. 27.

In this case, to exactly set the texture of the shag portion 378 in fabrication, a first positioning part 390 is disposed between the panel 374 and the picker 377 to position the picker 377 to panel 374 (see FIG. 27), and a second positioning part 395 is disposed between the subsidiary brush casing 372 and the panel 374 to position the panel 374 to the subsidiary brush casing 372 (see FIGS. 28 and 29). As illustrated in FIG. 27, the first positioning part 390 is preferably formed of a projection 392 and a projection-accommodating groove 391. The projection 392 is formed on a side of the undersurface of the panel 374, and the projection-accommodating groove 391 is formed in the picker 377 to accommodate the projection 392. As illustrated in FIGS. 28 and 29, the second positioning part 395 is preferably formed of two ribs 396 and two rib-accommodating spaces 397. The two ribs 396 are formed on a undersurface of the subsidiary brush casing 372, so that they are apart from the center of the subsidiary brush casing 372 in different distances, and the two rib-accommodating spaces 397 are formed on an upper surface of the panel 374 to correspond to the ribs 396 and to accommodate the ribs 396.

Accordingly, in fabrication, if while the projection 392 of the panel 374 is aligned with and inserted into the protrusion-accommodating grooves 391, the picker 377 is attached to the undersurface of the panel 374 and while the ribs 396 of the subsidiary brush casing 372 are aligned with and inserted into the rib-accommodating spaces 397, the panel 374 is attached to the subsidiary brush casing 372, the picker 377, the panel 374 and the subsidiary brush casing 372 are assembled, so that the shag portion 378 of the picker 377 has the texture inclined the direction toward the drum brush unit 5.

An operation of the nozzle assembly 1' of the vacuum cleaner according to the fourth embodiment constructed as described above is the same as that of the nozzle assembly 1" of the third embodiment explained with reference to FIGS. 19 through 23, except that when the nozzle assembly body 2 of the nozzle assembly 1' is pulled in the direction of arrow A" as illustrated in FIG. 26A, the picker 377 scrapes against the dust or dirt to move and scatter it toward the drum brush unit 5 (that is, the direction of arrow A"), and when the nozzle assembly body 2 of the nozzle assembly 1' is pushed in a direction of arrow B" as illustrated in FIG. 26C, the picker 377 does not push the dust or dirt out of the nozzle assembly body 2 (that is, the direction of arrow B"). Accordingly, the operation of the nozzle assembly 1' of the fourth embodiment will not be explained.

As apparent from the foregoing description, according to the exemplary embodiments of the present disclosure, the nozzle assembly of the vacuum cleaner has the subsidiary brush unit disposed in front of the drum brush unit. Accordingly, the subsidiary brush unit preliminarily scrapes off the dust or dirt, particularly, the hair or the fur of the pet, which is not separate from the surface to be cleaned well, and the drum brush unit secondly brushes away and scatters the scraped dust or dirt to be drawn into the nozzle assembly, thereby improving cleaning efficiency for the dust or dirt, such as the hair or the fur of the pet.

Further, the nozzle assembly of the vacuum cleaner according to the exemplary embodiments of the present disclosure is configured, so that the subsidiary brush unit is pivotably disposed to the nozzle assembly body or the drum brush unit, thereby allowing the subsidiary brush to selectively come in contact or non-contact with the surface to be cleaned, such as the carpet or the like, according to whether there is need to use it. Accordingly, the nozzle assembly according to the exemplary embodiments of the present disclosure can extend a lifespan of the subsidiary brush. In addition, alternatively, the subsidiary brush unit can be rotated in the non-use position and then maintained in the rotated state only by pushing the button, thereby allowing the nozzle assembly to easily use.

Furthermore, the nozzle assembly of the vacuum cleaner according to the exemplary embodiments of the present disclosure is configured, so that the subsidiary brush unit can be assembled with or disassembled from the drum brush casing by engaging the brackets with or separating from the sliding rails. Accordingly, it is easy to mount and dismount the subsidiary brush unit on or from the drum brush casing.

Moreover, the nozzle assembly of the vacuum cleaner according to the exemplary embodiments of the present disclosure is configured, so that the subsidiary brush is elastically movable up and down and rotatable, or movable in the horizontal direction to the subsidiary brush casing. Accordingly, when the subsidiary brush is in the use state where it comes in contact with the surface to be cleaned, it always scrapes against the surface to be cleaned in the state, which presses the surface to be cleaned in the certain pressure, thereby allowing the subsidiary brush to always scrape against the surface to be cleaned in a proper contact area even though the surface to be cleaned is crooked or irregular and thus improving the cleaning efficiency for the dirt, such as the hair or the fur of the pet.

Also, if the subsidiary brush is formed of the picker having the texture inclined in one direction, that is, the direction toward the drum brush unit, it does not push out the dust or dirt when the nozzle assembly is pushed in the front direction, thereby preventing the dust or dirt from scattering and going into user's respiratory organs in cleaning.

In addition, if the subsidiary brush casing and the panel have the ribs and the rib-accommodating spaces, respectively, and the panel and the picker have the projection and the projection-accommodating groove, respectively, the subsidiary brush casing and the panel can be easily be assembled with the panel and the picker, respectively.

Although representative exemplary embodiments of the present disclosure have been shown and described in order to exemplify the principle of the present disclosure, the present disclosure is not limited to the specific embodiments. It will be understood that various modifications and changes can be made by one skilled in the art without departing from the spirit and scope of the disclosure as defined by the appended claims. Therefore, it shall be considered that such modifications, changes and equivalents thereof are all included within the scope of the present disclosure.

What is claimed is:

1. A nozzle assembly usable with an upright vacuum cleaner, comprising:

a nozzle assembly body;

a drum brush unit disposed in the nozzle assembly body, the drum brush unit having a drum brush disposed to move dirt or dust adhered to a surface to be cleaned while coming in rotational contact therewith;

a subsidiary brush unit disposed in front of the drum brush unit, and the subsidiary brush unit having a subsidiary brush to preliminarily move the dust or dirt adhered to the surface to be cleaned before the drum brush moves the dirt or dust adhered to the surface to be cleaned; and a locking unit disposed to the drum brush unit to selectively fix the subsidiary brush unit to the drum brush unit, wherein the subsidiary brush unit is rotatably connected to the drum brush unit to selectively maintain a contact state or a non-contact state to the surface to be cleaned, and, when the subsidiary brush unit maintains the contact state to the surface to be cleaned, the locking unit fixes the subsidiary brush unit to the drum brush unit, wherein the locking unit comprises:

a hook member to lock to the subsidiary brush unit; and a spring to press the hook member in an upward direction.

2. The nozzle assembly as claimed in claim 1, wherein the drum brush unit comprises a drum brush, and a drum brush casing to wrap the drum brush, and wherein the subsidiary brush unit is configured to join with or separate from the drum brush casing.

3. The nozzle assembly as claimed in claim 1, wherein the subsidiary brush unit further comprises:

a subsidiary brush casing; and a panel joined to a lower end of the subsidiary brush casing, wherein the subsidiary brush is joined to a lower end of the panel.

4. The nozzle assembly as claimed in claim 3, wherein the subsidiary brush casing is selectively locked to the hook member of the locking unit.

5. The nozzle assembly as claimed in claim 3, wherein the panel is configured to be elastically movable up and down and to be rotatable.

6. The nozzle assembly as claimed in claim 5, wherein the panel comprises:

a plurality of bosses formed on a upper surface thereof, each of the plurality of bosses having a spring disposed therein; and supporting axes formed on both ends thereof and rotatably supported in elongated holes formed in the subsidiary brush casing.

7. The nozzle assembly as claimed in claim 3, wherein the subsidiary brush comprises a plurality of protrusions projected from an undersurface thereof.

8. The nozzle assembly as claimed in claim 3, wherein the panel is disposed to be movable back and forth and in a horizontal direction with respect to the subsidiary brush casing.

9. A nozzle assembly usable with an upright vacuum cleaner, comprising:

a nozzle assembly body;

a drum brush unit disposed in the nozzle assembly body, the drum brush unit having a drum brush disposed to move dirt or dust adhered to a surface to be cleaned while coming in rotational contact therewith;

a subsidiary brush unit disposed in front of the drum brush unit, and the subsidiary brush unit having a subsidiary brush to preliminarily move the dust or dirt adhered to the surface to be cleaned before the drum brush moves the dirt or dust adhered to the surface to be cleaned; and a locking unit disposed to the drum brush unit to selectively fix the subsidiary brush unit to the drum brush unit, wherein the subsidiary brush unit is rotatably connected to the drum brush unit to selectively maintain a contact state or a non-contact state to the surface to be cleaned, and, when the subsidiary brush unit maintains the contact state to the surface to be cleaned, the locking unit fixes the subsidiary brush unit to the drum brush unit, wherein the drum brush unit comprises a drum brush casing to wrap the drum brush, wherein the subsidiary brush unit comprises a subsidiary brush casing, a panel joined to a lower end of the subsidiary brush casing, and the subsidiary brush joined to a lower end of the panel, and wherein the drum brush casing has at least one bracket disposed thereon, and the subsidiary brush casing has at least one cover arm rotatably joined to the bracket.

10. The nozzle assembly as claimed in claim 9, wherein the at least one bracket is configured to mount on or separate from the drum brush casing.

11. The nozzle assembly as claimed in claim 10, wherein the drum brush casing has at least one sliding rail disposed thereon, and the at least one bracket has at least one sliding groove joined with the at least one sliding rail.

12. The nozzle assembly as claimed in claim 9, wherein the panel is disposed to be movable back and forth and in a horizontal direction with respect to the subsidiary brush casing.

13. The nozzle assembly as claimed in claim 12, wherein the subsidiary brush unit further comprises at least one hinge bracket disposed between the panel and the subsidiary brush casing to hingedly fix the panel to the subsidiary brush casing and thus to move the panel in the horizontal direction to the subsidiary brush casing.

14. The nozzle assembly as claimed in claim 13, wherein the at least one hinge bracket comprises:

a body fixed to a fixing boss formed on an undersurface of the subsidiary brush casing; and a link member having at least one link hingedly fixed to the body and the panel by hinge screws.

15. The nozzle assembly as claimed in claim 14, wherein each of the hinge screws comprises:

a raised portion rotatably supported in one of hinge holes formed in both ends of the link member; and a screw portion screwed to the panel or body.

16. The nozzle assembly as claimed in claim 13, wherein the subsidiary brush comprises a picker attached to an undersurface of the panel, the picker being formed of a material selected from the group consisting of wool, cloth, and fabric with shag.

17. The nozzle assembly as claimed in claim 16, wherein the picker is formed, so that a shag portion thereof has a texture inclined in one direction.

18. The nozzle assembly as claimed in claim 17, further comprising:

a first positioning part disposed between the panel and the picker to position the picker to panel; and a second positioning part disposed between the subsidiary brush casing and the panel to position the panel to the subsidiary brush casing.

19. The nozzle assembly as claimed in claim 18, wherein the first positioning part comprises:

a projection formed on a side of the undersurface of the panel; and a projection-accommodating groove formed in the picker to accommodate the projection.

20. The nozzle assembly as claimed in claim 18, wherein the second positioning part comprises:

at least two ribs formed on a undersurface of the subsidiary brush casing, the two ribs being apart from the center of the subsidiary brush casing in different distances; and at least two rib-accommodating spaces formed on an upper surface of the panel to correspond to the ribs and to accommodate the ribs.

* * * * *